US007953360B2

(12) United States Patent
Kagawa

(10) Patent No.: US 7,953,360 B2
(45) Date of Patent: May 31, 2011

(54) FIXING APPARATUS AND IMAGE FORMING APPARATUS HAVING SAME

(75) Inventor: Toshiaki Kagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 418 days.

(21) Appl. No.: 12/245,333

(22) Filed: Oct. 3, 2008

(65) Prior Publication Data

US 2009/0092422 A1 Apr. 9, 2009

(30) Foreign Application Priority Data

Oct. 5, 2007 (JP) ..... P2007-262681

(51) Int. Cl.
*G03G 15/20* (2006.01)

(52) U.S. Cl. ..... 399/328; 399/329; 399/330; 399/331

(58) Field of Classification Search ..... 399/328–331; 219/216

See application file for complete search history.

(56) References Cited

U.S. PATENT DOCUMENTS

| | | | | |
|---|---|---|---|---|
| 5,406,362 | A * | 4/1995 | Mills | 399/126 |
| 6,445,902 | B1 | 9/2002 | Hirst et al. | |
| 2006/0245796 | A1 * | 11/2006 | Wu et al. | 399/328 |
| 2007/0196120 | A1 | 8/2007 | Maeda | |
| 2007/0217837 | A1 | 9/2007 | Yamana et al. | |
| 2007/0223953 | A1 | 9/2007 | Kagawa et al. | |
| 2007/0248389 | A1 * | 10/2007 | Asakura et al. | 399/328 |

FOREIGN PATENT DOCUMENTS

| | | | |
|---|---|---|---|
| CN | 101038471 | A | 9/2007 |
| JP | 50-56949 | | 5/1975 |
| JP | 50-62448 | | 5/1975 |
| JP | 52-64935 | | 5/1977 |
| JP | 54-33040 | | 3/1979 |
| JP | 7-56583 | | 3/1995 |
| JP | 7-175364 | A | 7/1995 |
| JP | 2002-328559 | A | 11/2002 |
| JP | 2005-221712 | A | 8/2005 |
| JP | 2007-57935 | | 3/2007 |
| JP | 2007-219450 | A | 8/2007 |
| JP | 2007-256856 | A | 10/2007 |

* cited by examiner

*Primary Examiner* — David M Gray
*Assistant Examiner* — G. M. Hyder
(74) *Attorney, Agent, or Firm* — Nixon & Vanderhye, P.C.

(57) ABSTRACT

A fixing apparatus includes a pair of fixing members composed of a fixing roller and a pressure roller that make pressure-contact with each other; an external heating belt for heating a surface of the fixing roller externally; and first and second external heating rollers having a heat source, for allowing the external heating belt to be suspended in a tensioned state. A sum of stiffnesses of the first and second external heating rollers is greater than or equal to a stiffness of the fixing roller.

21 Claims, 7 Drawing Sheets

FIXING APPARATUS AND IMAGE FORMING APPARATUS HAVING SAME

CROSS-REFERENCE TO RELATED APPLICATION

This application claims priority to Japanese Patent Application No. 2007-262681, which was filed on Oct. 5, 2007, the contents of which are incorporated herein by reference in its entirety.

BACKGROUND OF THE INVENTION

1. Field of the Invention

The present invention relates to a fixing apparatus for fixing a toner image onto a recording material, and an image forming apparatus having the same.

2. Description of the Related Art

As a fixing apparatus for use in an electrophotographic image forming apparatus such as a copying machine and a printer, a fixing apparatus of heat-roller fixing type has been in wide use. FIG. 7 is a front view showing a configuration example of a conventional heat-roller fixing-type fixing apparatus 70 in simplified form. The heat-roller fixing-type fixing apparatus 70 includes a pair of rollers, to be more specific, a fixing roller 71 and a pressure roller 72, that are brought into contact with each other under pressure. By means of a heating section composed for example of a halogen heater, which is placed in each of or one of the pair of rollers interiorly thereof, for example, a heater lamp 73 placed inside the fixing roller 71, the pair of rollers are heated to a predetermined fixing temperature. With the pair of rollers kept in a heated state, a recording sheet P, which is a recording material having formed thereon an unfixed toner image T, is fed to a region where the pair of rollers make pressure-contact with each other, namely a so-called fixing nip region N1. Upon the recording sheet P passing through the fixing nip region N1, the toner image is fixed into place under application of heat and pressure.

Moreover, a fixing apparatus for use in a color image forming apparatus generally employs an elastic roller constructed by forming an elastic layer made for example of silicone rubber on a surface layer of the fixing roller 71. By designing the fixing roller 71 as an elastic roller, it is possible for the surface of the fixing roller 71 to become elastically deformed so as to conform to irregularities of the unfixed toner image, wherefore the fixing roller 71 makes contact with the toner image so as to cover the surface of the toner image. This makes it possible to perform satisfactory thermal fixation on the unfixed color toner image that is larger in toner adherent amount than a monochromatic toner image. Moreover, by virtue of a deflection-releasing effect exerted by the elastic layer in the fixing nip region N1, it is possible to provide enhanced mold releasability for a color toner that is more susceptible to occurrence of offset than a monochromatic toner. Further, since the fixing nip region N1 is convexly curved in a radially-outward direction so as to define a so-called reverse nip configuration, it is possible to attain higher paper-stripping capability. That is, a paper stripping action can be produced without using a stripping portion such as a stripping paw1 (self-stripping action), wherefore image imperfection caused by the provision of the stripping portion can be eliminated.

In the fixing apparatus 70 thus constructed, an increase of a fixing nip width, namely the width of the fixing nip region N1, may be considered as an attempt to keep up with higher and higher process speeds. The examples of methods for increasing the fixing nip width include an increase in the thickness of the elastic layer of the fixing roller 71 and an increase in the diameter of the fixing roller 71.

In the fixing roller 71 having the elastic layer, however, the elastic layer in itself exhibits extremely low thermal conductivity. Therefore, an increase in the thickness of the elastic layer may lead, in a case of providing a heating section within the fixing roller 71, to further reduction in heat transfer efficiency. In this case, if the process speed is increased, there is a possibility that the temperature of the fixing roller 71 cannot stay close to a fixing temperature. On the other hand, an increase in the diameter of the fixing roller 71 may lead to prolonged warm-up period of time, which results in higher power consumption.

In order to solve such problems, there has been proposed a technique to apply heat to the surface of the fixing roller 71 externally by means of a heating roller 75 which is brought into pressure-contact with the fixing roller 71 and has a heater lamp 74 disposed in it. In the fixing apparatus 70 thus constructed, on the basis of temperature data obtained through detection by, for example, a temperature detecting section 76 disposed in the vicinity of the outer peripheral surface of the heating roller 75 and a temperature detecting section 77 disposed in the vicinity of the outer peripheral surface of the fixing roller 71, temperature control is exercised over the heater lamps 73 and 74.

By way of the technique as described hereinabove, for example, Japanese Examined Patent Publication JP-B2 54-15215 (1979) discloses a toner-image fixing apparatus in which, as a thermally-fusing roller which is brought into contact with an image-bearing surface of a material for holding a toner image, a heat-insulating elastic roller is applied for use. Moreover, a heating roller having a heat source disposed thereinside is disposed so as to make pressure-contact with the elastic roller. The elastic roller is heated externally by this heating roller. The image holding material on which is borne a toner image is caused to pass through a region between the elastic roller and a rigid pressure-contact roller. In the toner-image fixing apparatus, in order to keep the surface temperature of the elastic roller substantially constant, the elastic roller is made smaller in diameter than the heating roller, and the preset temperature of the heating roller is changed to rise only at the time of the passage of the image holding material.

Moreover, Japanese Unexamined Patent Publication JP-A 50-62448 (1975) discloses a toner-image fixing apparatus in which, as a thermally-fusing roller which is brought into contact with a toner image-bearing surface of a material for holding a toner image, a heat-insulating elastic roller is applied for use. In a region between the elastic roller and a rigid pressure-contact roller whose diameter is larger than that of the elastic roller, the toner image holding material on which is borne a toner image is caused to pass. In the toner-image fixing apparatus, the surface of the elastic roller is heated externally by a heating roller whose diameter is larger than that of the elastic roller.

Further, Japanese Unexamined Patent Publication JP-A 52-64935 (1977) discloses a fixing apparatus in which a fixing roller having a silicone rubber layer is heated externally on contact with pressure-contact rollers having a heating source disposed thereinside disposed so as to have sandwiched therebetween the fixing roller in a vertical direction. In the fixing apparatus, the fixing roller is rotated dependently with the rotation of the pressure-contact roller without causing slipping.

Still further, Japanese Unexamined Patent Publication JP-A 54-33040 (1979) discloses a heat fixing apparatus in which a fixing roller having an elastic body is heated externally on pressure-contact with a heating roller and a pressure roller with a heating source disposed thereinside that are made larger in diameter than the fixing roller. In the heat fixing apparatus, the surface temperature of the pressure roller is detected and, on the basis of the result of detection, turn-on control is exercised to actuate the heater of the pressure roller and the heater of the heating roller at the same time.

In addition, Japanese Examined Patent Publication JP-B2 7-56583 (1995) discloses a heat fixing apparatus in which a fixing roller having a silicone rubber is heated externally on pressure-contact with an upper pressure roller and a lower pressure roller having a heating source disposed thereinside. In the heat fixing apparatus, selection between a full-color image copying mode and a monochromatic image copying mode is effected by switch operation. In accordance with the condition of unfixed toner in the selected mode, the heating temperatures of the upper and lower pressure rollers are controlled properly.

In the fixing apparatuses disclosed in JP-B2 54-15215, JP-A 50-62448, JP-A 52-64935, JP-A 54-33040, and JP-B2 7-56583, the fixing roller is heated externally by using the heating roller and the pressure roller. In such a construction, however, even if the heating roller for use is made larger in diameter than the fixing roller, as practiced in JP-B2 54-15215 and JP-A 50-62448, the dimension of a heating nip width, which is the width of the region where the fixing roller and the heating roller are kept in contact with each other, is inadequate. In consequence, the efficiency in heating of the fixing roller is so low that it becomes impossible to achieve a large increase in process speed.

Furthermore, in the absence of a heating section within the fixing roller, the fixing roller cannot be pre-heated evenly during standby. This gives rise to a problem of prolonged first copy output time (hereafter expressed as "FCOT", which is a period of time taken to complete image formation for the first time around).

SUMMARY OF THE INVENTION

The invention has been devised in an effort to solve the problems thus far described, and accordingly its object is to provide an energy-efficient fixing apparatus that excels in fixing roller's temperature follow-up capability, fixability, and paper conveyance capability even at higher rates of process speed, as well as to provide an image forming apparatus having the same.

The invention provides a fixing apparatus comprising:

a pair of fixing members composed of a fixing roller and a pressure member that make contact with each other under pressure;

a first external heating belt for heating a surface of the fixing roller externally; and a plurality of first external heating members having a heat source, for allowing the first external heating belt to be suspended in a tensioned state, a sum of stiffnesses of the plurality of first external heating members being greater than or equal to a stiffness of the fixing roller.

According to the invention, the fixing apparatus comprises: a pair of fixing members composed of a fixing roller and a pressure member that make contact with each other under pressure; a first external heating belt for heating a surface of the fixing roller externally; and a plurality of first external heating members having a heat source, for allowing the first external heating belt to be suspended in a tensioned state. In this construction, a sum of stiffnesses of the plurality of first external heating members is greater than or equal to a stiffness of the fixing roller.

In this way, with use of the first external heating belt as a component for heating the surface of the fixing roller externally, a sufficiently-large heating nip width can be secured. This makes it possible to enhance the efficiency in heating of the fixing roller. Accordingly, even if the process speed is increased, it is possible for the temperature of the fixing roller to stay close to a fixing temperature. Moreover, since the diameter of the fixing roller can be reduced, it is possible to shorten warm-up period of time and thereby reduce power consumption.

Moreover, the sum of the stiffnesses of the plurality of first external heating members is greater than or equal to the stiffness of the fixing roller. In this case, a reaction force exerted on the fixing roller via the first external heating member against a fixing load applied from the pressure member can be raised to a level that permits suppression of fixing-roller deflection. This makes it possible to obtain a satisfactory effect of suppressing the deflection of the fixing roller and thereby attain excellent fixability and paper conveyance capability.

It will thus be seen that, even if the process speed is increased, the fixing apparatus of the invention is excellent in terms of fixing roller's temperature follow-up capability, fixability, paper conveyance capability, and energy conservation.

Moreover, in the invention, it is preferable that the fixing roller has a heat source disposed in its interior, whereas the pressure member has not a heat source.

According to the invention, the fixing roller has a heat source disposed in its interior, whereas the pressure member has not a heat source. In this case, with the provision of a heat source inside the fixing roller, it is possible to achieve adequate pre-heating and thereby shorten FCOT. Accordingly, higher energy-saving effect can be attained.

Moreover, in the invention, it is preferable that the stiffness of the pressure member is greater than or equal to twice the stiffness of the fixing roller.

According to the invention, the stiffness of the pressure member is greater than or equal to twice the stiffness of the fixing roller. In this case, it is possible to raise a reaction force developed against a load applied from the fixing roller and the first external heating member to a level that permits suppression of deflection in the pressure member. This makes it possible to obtain a satisfactory effect of suppressing the deflection of the pressure roller and thereby attain excellent fixability and paper conveyance capability.

Moreover, the invention provides a fixing apparatus comprising:

a pair of fixing members composed of a fixing roller and a pressure member that make contact with each other under pressure;

a first external heating belt for heating a surface of the fixing roller externally;

a plurality of first external heating members having a heat source, for allowing the first external heating belt to be suspended in a tensioned state;

a second external heating belt for heating a surface of the pressure member externally; and a plurality of second external heating members having a heat source, for allowing the second external heating belt to be suspended in a tensioned state, a sum of stiffnesses of the plurality of first external heating members being greater than or equal to a stiffness of the fixing roller, and a sum of a stiffness of the pressure member and stiffnesses of the plurality of second external heating members being greater than or equal to twice the stiffness of the fixing roller.

According to the invention, the fixing apparatus comprises: a pair of fixing members composed of a fixing roller and a pressure member that make contact with each other under pressure; a first external heating belt for heating a surface of the fixing roller externally; a plurality of first external heating members having a heat source, for allowing the first external heating belt to be suspended in a tensioned state; a second external heating belt for heating the surface of the pressure member externally; and a plurality of second external heating members having a heat source, for allowing the second external heating belt to be suspended in a tensioned state. In this construction, a sum of stiffnesses of the plurality of first external heating members is greater than or equal to a stiffness of the fixing roller, and a sum of a stiffness of the pressure member and stiffnesses of the plurality of second external heating members is greater than or equal to twice the stiffness of the fixing roller. Note that a heat source may be disposed inside the fixing roller and inside the pressure member as well.

In this way, with the provision of a mechanism for heating the pressure member, in addition to the effects as described hereinabove, the following effects can be achieved: even if the process speed is increased even further, the temperature of the pressure member can be maintained at a level adaptable to the increase of the process speed. This makes it possible to produce a fixing apparatus that offers excellent temperature follow-up capability and fixability.

Moreover, by setting the sum of the stiffness of the pressure member and the stiffnesses of the plurality of second external heating members to be greater than or equal to twice the stiffness of the fixing roller, it is possible to raise a reaction force developed against a load applied from the fixing roller and the first external heating member to a level that permits suppression of pressure-member deflection. This makes it possible to obtain a satisfactory effect of suppressing the deflection of the pressure member and thereby attain excellent fixability and paper conveyance capability.

It will thus be seen that, even if the process speed is increased even further, the fixing apparatus of the invention is excellent in terms of fixing roller's temperature follow-up capability, fixability, paper conveyance capability, and energy conservation.

Moreover, in the invention, it is preferable that the plurality of first external heating members are designed in a same configuration, and are symmetrically arranged with respect to a line connecting a center of axis of the fixing roller and a center of a fixing nip region where the fixing roller and the pressure member are in contact with each other.

According to the invention, the plurality of first external heating members are designed in a same configuration, and are symmetrically arranged with respect to the line connecting the center of axis of the fixing roller and the center of the fixing nip region where the fixing roller and the pressure member are in contact with each other. In this case, a heating nip region, which is a region where the first external heating belt and the fixing roller are in contact with each other, can be formed with uniformity, wherefore the fixing nip region can be heated evenly.

Moreover, in the invention, it is preferable that one of the plurality of first external heating members is disposed, in a vicinity of an outer peripheral surface of the fixing roller, so as to be located opposite a fixing nip region where the fixing roller and the pressure roller are in contact with each other with respect to the axis of the fixing roller.

According to the invention, one of the plurality of first external heating members is disposed, in a vicinity of an outer peripheral surface of the fixing roller, so as to be located opposite a fixing nip region where the fixing roller and the pressure roller are in contact with each other with respect to the axis of the fixing roller.

In this case, one of the plurality of first external heating members is placed at a suitable position so that occurrence of deflection in the fixing roller can be suppressed most effectively. With this arrangement, there is no need to impart a function of suppressing the deflection of the fixing roller to the other first external heating member. This makes it possible to provide another additional function, for example, a heat-conductive function, and thereby produce a fixing apparatus having higher performance capability.

Moreover, in the invention, it is preferable that, out of the plurality of first external heating members, one which is disposed, in a vicinity of an outer peripheral surface of the fixing roller, so as to be located opposite the fixing nip region with respect to the axis of the fixing roller exhibits the highest stiffness.

According to the invention, out of the plurality of first external heating members, one which is disposed, in a vicinity of an outer peripheral surface of the fixing roller, so as to be located opposite the fixing nip region with respect to the axis of the fixing roller exhibits the highest stiffness.

In this case, a reaction force developed via the first external heating member against a fixing load can be increased effectively, wherefore occurrence of deflection in the fixing roller can be suppressed more reliably.

Moreover, in the invention, it is preferable that, out of the plurality of first external heating members, one other than the first external heating member which is disposed, in the vicinity of the outer peripheral surface of the fixing roller, so as to be located opposite the fixing nip region with respect to the axis of the fixing roller is made higher in longitudinal thermal conduction than the first external heating member which is disposed, in the vicinity of the outer peripheral surface of the fixing roller, so as to be located opposite the fixing nip region.

According to the invention, out of the plurality of first external heating members, one other than the first external heating member which is disposed, in the vicinity of the outer peripheral surface of the fixing roller, so as to be located opposite the fixing nip region with respect to the axis of the fixing roller is made higher in longitudinal thermal conduction than the first external heating member which is disposed, in the vicinity of the outer peripheral surface of the fixing roller, so as to be located opposite the fixing nip region.

In this case, the longitudinal thermal conduction of the above-described first external heating member can be enhanced, wherefore the degree of temperature variation in the direction of the width of the external heating belt, as well as in the direction longitudinally of the fixing roller, can be decreased. Accordingly, even if recording sheets whose widths are smaller than the length of the longer side of the fixing roller are fed one after another, it never occurs that the non-paper-passing region of the fixing roller undergoes abnormal temperature elevation. This makes it possible to suppress occurrence of temperature rise in the non-paper-passing region.

Moreover, in the invention, it is preferable that, out of the plurality of first external heating members, one other than the first external heating member which is disposed, in the vicinity of the outer peripheral surface of the fixing roller, so as to be located opposite the fixing nip region with respect to the axis of the fixing roller has not a heat source.

According to the invention, out of a plurality of first external heating members, one other than the first external heating member which is disposed, in the vicinity of the outer peripheral surface of the fixing roller, so as to be located opposite the fixing nip region with respect to the axis of the fixing roller has not a heat source. This makes it possible to provide another additional function, for example, a heat-conductive function, and thereby produce a fixing apparatus having higher performance capability.

Moreover, in the invention, it is preferable that, out of the plurality of first external heating members, one other than the first external heating member which is disposed, in the vicinity of the outer peripheral surface of the fixing roller, so as to be located opposite the fixing nip region with respect to the axis of the fixing roller is provided with a heat pipe extending along the direction longitudinally thereof.

According to the invention, out of the plurality of first external heating members, one other than the first external heating member which is disposed, in the vicinity of the outer peripheral surface of the fixing roller, so as to be located opposite the fixing nip region with respect to the axis of the fixing roller is provided with a heat pipe extending along the direction longitudinally thereof.

In this case, it is possible to enhance the longitudinal thermal conduction of the above-described first external heating member without fail, and thereby reduce temperature variation in the direction of the width of the external heating belt, as well as in the direction longitudinally of the fixing roller, without fail.

Moreover, in the invention, it is preferable that at least one of the plurality of first external heating members is designed to have a crown shape in which, when viewed in a direction longitudinally thereof, an outer diameter at its midportion is larger than an outer diameter at its opposite ends.

According to the invention, at least one of the plurality of first external heating members is designed to have a crown shape in which, when viewed in the direction longitudinally thereof, the outer diameter at its midportion is larger than the outer diameter at its opposite ends.

In this case, it is possible to exert, on the longitudinal midportion of the fixing roller that may undergo deflection to the highest degree, a reaction force to cope with a larger fixing load, and thereby suppress occurrence of deflection in the fixing roller more effectively.

Moreover, in the invention, it is preferable that the plurality of second external heating members have a same construction as the plurality of first external heating members.

According to the invention, the plurality of second external heating members have a same construction as the plurality of first external heating members. This makes it possible to produce a fixing apparatus having higher performance capability.

Moreover, the invention provides an image forming apparatus having the fixing apparatus thus far described.

According to the invention, The image forming apparatus has the fixing apparatus thus far described. The image forming apparatus is excellent in terms of fixing roller's temperature follow-up capability, fixability, paper conveyance capability, and energy conservation, even if the process speed is increased.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
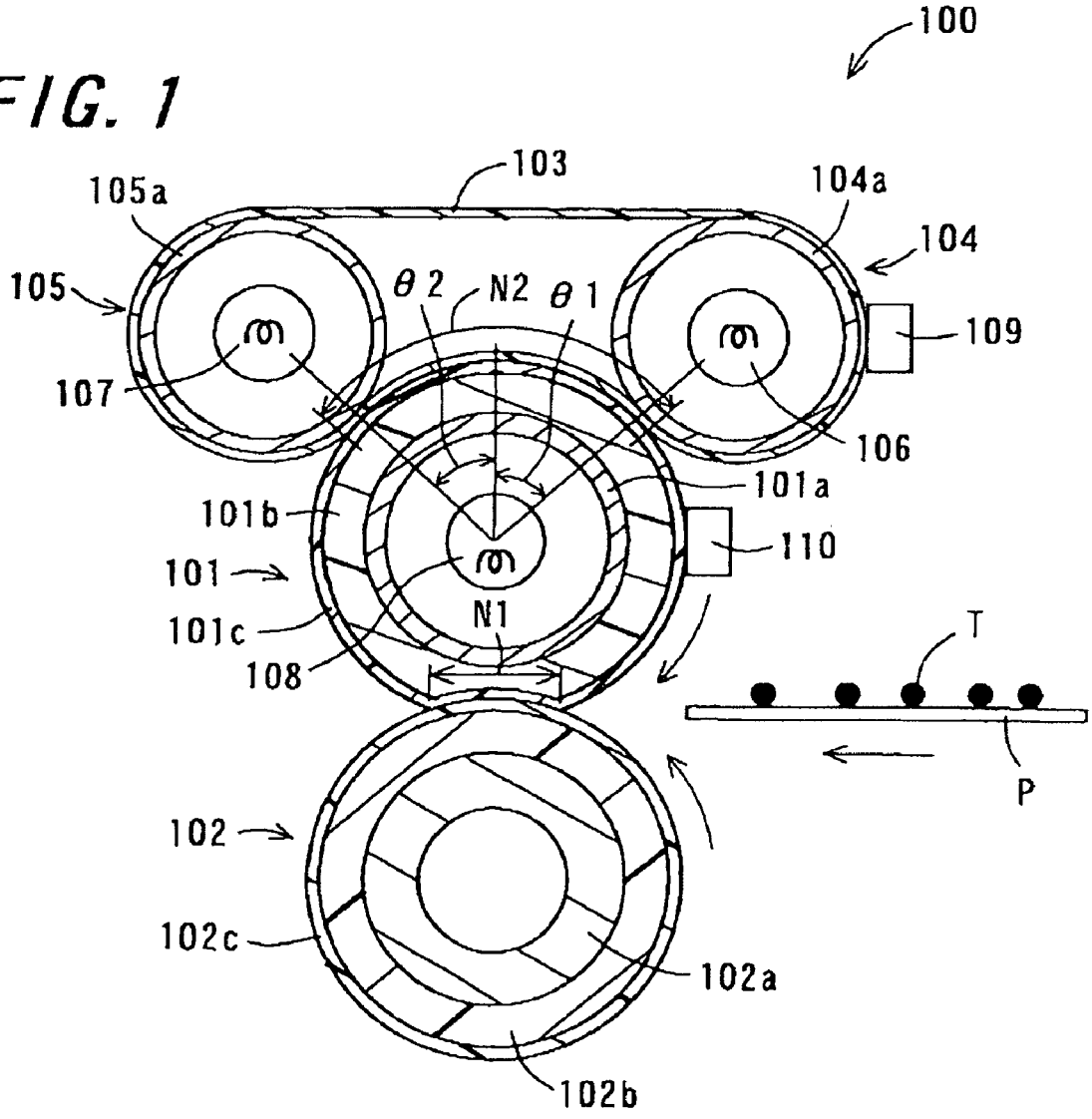
FIG. 1 is a sectional view showing the structure of a fixing apparatus in accordance With a first embodiment of the invention in simplified form.

Now referring to the drawings, preferred embodiments of the invention will be described in detail.

A fixing apparatus of the invention comprises: a pair of fixing members composed of a fixing roller and a pressure member that make contact with each other under pressure; a first external heating belt for heating the surface of the fixing roller externally; and a plurality of first external heating members having a heat source, for allowing the first external heating belt to be suspended in a tensioned state. In this construction, a sum of stiffnesses of the plurality of first external heating members is greater than or equal to a stiffness of the fixing roller.

In this way, with use of the first external heating belt as means for heating the surface of the fixing roller externally, a sufficiently-large heating nip width can be secured. This makes it possible to enhance the efficiency in heating of the fixing roller. Accordingly, even if the process speed is increased, it is possible for the temperature of the fixing roller to stay close to a fixing temperature while maintaining the large thickness of the elastic layer of the fixing roller. Moreover, since the diameter of the fixing roller can be reduced, it is possible to shorten warm-up period of time and thereby reduce power consumption.

In general, the fixing roller and the pressure member are brought into pressure-contact with each other under a predetermined fixing load. This gives rise to a problem that the fixing roller undergoes deflection in a direction in which the fixing load is applied thereto from the pressure member. Occurrence of such a deflection in the fixing roller can be suppressed effectively by disposing, in the vicinity of the outer peripheral surface of the fixing roller, a member having a relatively high mechanical strength at a position near the location opposite a fixing nip region where the fixing roller and the pressure member are in contact with each other with respect to the axis of the fixing roller. In a conventional fixing apparatus such as the fixing apparatus 70 shown in FIG. 7, the external heating roller having a high mechanical strength is disposed, in the vicinity of the outer peripheral surface of the fixing roller, so as to be located opposite the fixing nip region with respect to the axis of the fixing roller. Therefore, a reaction force developed via the external heating roller against a fixing load applied from the pressure member is great enough to suppress occurrence of deflection in the fixing roller. However, in a case where, just as is the case with the fixing apparatus embodying the invention, an external heating belt is used in place of the external heating roller, a reaction force developed via the external heating belt against the fixing load applied from the pressure member is inadequate, in consequence whereof there results deflection in the fixing roller.

The invention is based on the fact that the fixing-roller deflection problem which arises in the case of using the external heating belt can be overcome by focusing attention on the stiffness of the first external heating member.

That is, in the fixing apparatus of the invention, the sum of the stiffnesses of the plurality of first external heating members is greater than or equal to the stiffness of the fixing roller. In this case, a reaction force exerted on the fixing roller via the first external heating member against the fixing load applied from the pressure member can be raised to a level that permits suppression of fixing-roller deflection. This makes it possible to obtain a satisfactory effect of suppressing the deflection of the fixing roller and thereby attain excellent fixability and paper conveyance capability.

By virtue of the features described hereinabove, even if the process speed is increased, the fixing apparatus of the invention is excellent in terms of fixing roller's temperature follow-up capability, fixability, paper conveyance capability, and energy conservation.

Moreover, it is preferable that, in the fixing apparatus of the invention, the fixing roller has a heat source disposed in its interior part, whereas the pressure member has not a heat source. In this case, since the fixing roller has the heat source disposed thereinside, it is possible to achieve adequate preheating and thereby shorten FCOT. Accordingly, higher energy-saving effect can be attained.

Moreover, in the fixing apparatus of the invention, a stiffness sum obtained by adding up the stiffness of the fixing roller and the sum of the stiffnesses of the plurality of first external heating members is greater than or equal to twice the stiffness of the fixing roller. If the pressure member-side stiffness is lower than this value, there is a possibility that deflection occurs on the pressure member side.

Accordingly, in the fixing apparatus of the invention, it is preferable that the stiffness of the pressure member is greater than or equal to twice the stiffness of the fixing roller. In this case, a reaction force developed against a load applied from the fixing roller and the first external heating member can be raised to a level that permits suppression of pressure-member deflection. This makes it possible to obtain a satisfactory effect of suppressing the deflection of the pressure member and thereby attain excellent fixability and paper conveyance capability.

A fixing apparatus of the invention also comprises: a pair of fixing members composed of a fixing roller and a pressure member that make contact with each other under pressure; a first external heating belt for heating the surface of the fixing roller externally; a plurality of first external heating members having a heat source, for allowing the first external heating belt to be suspended in a tensioned state; a second external heating belt for heating the surface of the pressure member externally; and a plurality of second external heating members having a heat source, for allowing the second external heating belt to be suspended in a tensioned state. In this construction, a sum of stiffnesses of the plurality of first external heating members is greater than or equal to a stiffness of the fixing roller, and a sum of the stiffness of the pressure member and stiffnesses of the plurality of second external heating members is greater than or equal to twice the stiffness of the fixing roller.

In this way, with the provision of a mechanism for heating the pressure member, in addition to the effects as described hereinabove, the following effects can be achieved: even if the process speed is increased even further, the temperature of the pressure member can be maintained at a level adaptable to the increase of the process speed. This makes it possible to produce a fixing apparatus that offers excellent temperature follow-up capability and fixability.

On the other hand, for example, in a case where the pressure member is provided with a heat source, it is difficult to make the stiffness of the pressure member greater than or equal to twice the stiffness of the fixing roller. However, by setting the sum of the stiffness of the pressure member and the stiffnesses of the plurality of second external heating members to be greater than or equal to twice the stiffness of the fixing roller, it is possible to raise a reaction force developed against a load applied from the fixing roller and the first external heating member to a level that permits suppression of pressure-member deflection. This makes it possible to obtain a satisfactory effect of suppressing the deflection of the pressure member and thereby attain excellent fixability and paper conveyance capability.

By virtue of the features described hereinabove, even if the process speed is increased, the fixing apparatus of the invention is excellent in terms of fixing roller's temperature follow-up capability, fixability, paper conveyance capability, and energy conservation.

In the specification, for example, the stiffness of each roller is equivalent to a value obtained as follows. That is, the stiffness of each roller can be represented by the product of a Young's modulus $\sigma$ (based on the material of the roller) and a geometrical moment of inertia M (based on the diameter (outer diameter) and thickness of the roller): ($\sigma \times M$). Note that the stiffness of the first external heating member, as well as the stiffness of the second external heating member, can be represented, with use of a mounting angle $\theta 1$ ($\theta 2$) as will hereafter be described, by the product of a Young's modulus $\sigma$, a geometrical moment of inertia M, and a mounting angle $\theta 1$ ($\theta 2$) ($\sigma \times M \times \cos \theta 1$) or ($\sigma \times M \times \cos \theta 2$). The larger is the value thereby obtained, the greater is the stiffness.

[Fixing Apparatus]

First Embodiment

FIG. 1 is a sectional view showing the structure of a fixing apparatus 100 in accordance with a first embodiment of the invention in simplified form. In the fixing apparatus 100 implemented by way of the first embodiment of the invention, a recording sheet P having an unfixed toner image T formed on its surface is subjected to application of heat and pressure, so that the toner image T is thermally-fused and is eventually fixed onto the recording sheet P. The unfixed toner image T is composed of, for example, a nonmagnetic one-component type developer containing nonmagnetic toner, a nonmagnetic two-component type developer containing nonmagnetic toner and carrier, or a magnetic developer containing magnetic toner (hereafter referred to simply as "toner").

As shown in FIG. 1, the fixing apparatus 100 comprises: a fixing roller 101 and a pressure roller 102 constituting a pair of fixing members, which are brought into contact with each other under pressure; an external heating belt 103 designed as an endless belt for heating the surface of the fixing roller 101 externally; a first external heating roller 104 and a second external heating roller 105 for heating and suspending the external heating belt 103 in a tensioned state; a first heater lamp 106 acting as a heat source for heating the first external heating roller 104; a second heater lamp 107 acting as a heat source for heating the second external heating roller 105; a third heater lamp 108 acting as a heat source for heating the fixing roller 101 from within; a first thermistor 109 acting as a temperature sensor for detecting a surface temperature of the external heating belt 103; and a second thermistor 110 acting as a temperature sensor for detecting a surface temperature of the fixing roller 101. The pressure roller 102 corresponds to the pressure member. The external heating belt 103 corresponds to the first external heating belt. The first external heating roller 104 and the second external heating roller 105 correspond to a plurality of first external heating members.

The fixing roller 101, which constitutes a fixing member, is heated to a predetermined temperature, for example, 190° C. thereby to apply heat to the recording sheet P bearing the unfixed toner image T thereon passing through a fixing nip region N1 where the fixing roller 101 and the pressure roller 102 are in contact with each other. The fixing roller 101 has its outer peripheral surface supported so as to be revolvable, and takes on a three-layer structure consisting of, from inside to outside, a metal core 101*a*, an elastic layer 101*b*, and a release layer 101*c*. As the metal core 101*a*, for example, a metal material such as iron, stainless steel, aluminum, and copper, or an alloy thereof may be used. As the elastic layer 101*b*, for example, silicone rubber may be used. As the release layer 101*c*, for example, fluorine resin such as PFA (copolymer of tetrafluoroethylene and perfluoroalkyl vinyl ether) and PTFE (polytetrafluoroethylene) may be used.

Inside the fixing roller 101 is disposed the third heater lamp 108 acting as a heat source for heating the fixing roller 101 from within. A control circuit (not shown) effects control of a power circuit (not shown) in a manner so as to supply power to the third heater lamp 108, whereby the third heater lamp 108 is allowed to emanate light to cause infrared ray emission. Then, the inner peripheral surface of the fixing roller 101 is heated through infrared ray absorption, and eventually the fixing roller 101 can wholly be heated. In this way, since the fixing roller 101 has the third heater lamp 108 disposed thereinside, it is possible to achieve adequate pre-heating and thereby shorten FCOT. Accordingly, higher energy-saving effect can be attained.

The pressure roller 102, which constitutes the fixing member, is designed to rotate while making pressure-contact with the outer peripheral surface of the fixing roller 101. The pressure roller 102 is similar in construction to the fixing roller 101. For example, the pressure roller 102 is constructed by forming, over the outer peripheral surface of a metal core 102*a* made of metal such as iron, stainless steel, aluminum, and copper, or an alloy thereof, an elastic layer 102*b* made of silicone rubber or the like and a release layer 102*c* made of fluorine resin such as PFA and PTFE successively in the order named. In the fixing apparatus 100, the pressure roller 102 has not a heat source.

Moreover, it is preferable that the stiffness of the pressure roller 102 is greater than or equal to twice the stiffness of the fixing roller 101. For example, given the stiffness of the fixing roller 101 (represented by ($\sigma \times M$)) of $2.32 \times 10^7$, then the stiffness of the pressure roller 102 (represented by ($\sigma \times M$)) is $6.76 \times 10^7$. By doing so, it is possible to raise a reaction force developed against a load applied from the fixing roller 101, the first external heating roller 104, and the second external heating roller 105 to a level that permits suppression of deflection in the pressure roller 102. This makes it possible to obtain a satisfactory effect of suppressing the deflection of the pressure roller 102 and thereby attain excellent fixability and paper conveyance capability.

The fixing roller 101 and the pressure roller 102 are brought into pressure-contact with each other under a predetermined fixing load, for example, 176 N, with the fixing nip region N1 secured therebetween, where the fixing roller 101 and the pressure roller 102 are in contact with each other. The width of the fixing nip region N1 in a direction in which the recording sheet P is conveyed, namely a fixing nip width, is set at 8 mm, for example. The recording sheet P having the unfixed toner image T formed on its surface is fed to the fixing nip region N1. Upon the recording sheet P passing through the fixing nip region N1, the toner image T is fixed onto the recording sheet P. During the interval when the recording sheet P is passing through the fixing nip region N1, the fixing roller 101 is kept in contact with the toner image-bearing surface of the recording sheet P, whereas the pressure roller 102 is kept in contact with the other surface of the recording sheet P opposite from the toner image-bearing surface.

The fixing roller 101 is rotatably driven by a driving motor (not shown). Moreover, the pressure roller 102 is rotated dependently with the rotation of the fixing roller 101. Therefore, as shown in FIG. 1, the fixing roller 101 and the pressure roller 102 are rotated in different directions. In this state, the recording sheet P passes through the fixing nip region N1.

In the fixing nip region N1, the recording sheet P having formed thereon the unfixed toner image T is conveyed at predetermined fixing and copying speeds, and the toner image is fixed into place under application of heat and pressure. The fixing speed, which means a so-called process speed, is set at 173 mm/sec, for example. The copying speed means the number of copies per minute. For example, in a case where A4-size recording sheets are fed successively in the direction longitudinally thereof (A4 longitudinal feeding), the copying speed is set at 30 copies/min.

The external heating belt 103 is designed as an endless belt which is turnably laid, in a tensioned state, across the first external heating roller 104 and the second external heating roller 105 that are so arranged as to touch internally the external heating belt 103 to effect application of heat. The first external heating roller 104 and the second external heating roller 105 are so arranged as to be rotatable about two axes substantially parallel to the axis of the fixing roller 101 and the axis of the pressure roller 102, respectively. The first external heating roller 104 and the second external heating roller 105 are each disposed, in the vicinity of the outer peripheral surface of the fixing roller 101, at a position near the location opposite the fixing nip region N1 with respect to the axis of the fixing roller 101. The first external heating roller 104 and the second external heating roller 105 are spaced apart to provide a center-to-center distance of, for example, 27 mm, so that at least the external heating belt 103 is displaceable.

Moreover, in the vicinity of the outer peripheral surface of the fixing roller 101, the first external heating roller 104 is disposed as follows. Assuming that a direction in which the fixing roller 101 undergoes deflection under a fixing load applied from the pressure roller 102, namely a direction in which a straight line segment connecting the center of the fixing roller 101 and the center of the pressure roller 102 extends, is defined an angular reference direction, then the first external heating roller 104 is disposed in such a manner that, out of the two angles that a direction in which a straight line segment connecting the center of the first external heating roller 104 and the center of the fixing roller 101 extends forms with the angular reference direction, the smaller one θ1 (hereafter referred to as "mounting angle θ1") is 45°. On the other hand, the second external heating roller 105 is disposed in such a manner that, out of the two angles that a direction in which a straight line segment connecting the center of the second external heating roller 105 and the center of the fixing roller 101 extends forms with the angular reference direction, the smaller one θ2 (hereafter referred to as "mounting angle θ2") is 45°. The first external heating roller 104 and the second external heating roller 105 are arranged in contact with the outer peripheral surface of the fixing roller 101.

The external heating belt 103 is, in a natural state, stretched under a tension of a level that prevents the external heating belt 103 from being inadvertently displaced in the axial direction of the first external heating roller 104, as well as the axial direction of the second external heating roller 105. The external heating belt 103 is disposed, with its outer peripheral surface, namely a surface facing the fixing roller 101 brought into contact with the outer peripheral surface of the fixing roller 101.

The external heating belt 103 is designed in a two-layer construction; that is, constructed by forming, on a surface of a hollow cylindrical base material made of heat-resistant resin such as polyimide or a metal material such as stainless and nickel, a layer acting as a release layer made of a synthetic resin material offering excellent heat resistance and mold releasability, for example, a layer made of fluorine resin such as PFA and PTFE Moreover, in order to reduce an offset force against the external heating belt 103, namely a force exerted on the external heating belt 103 to cause it to move in a direction perpendicular to a direction in which the external heating belt 103 turns, the belt base material may have its inner peripheral surface coated with fluorine resin or the like.

For example, the first external heating roller 104 and the second external heating roller 105 are composed of hollow cylindrical metal-made core members 104*a* and 105*a*, respectively, that are made for example of aluminum and an iron-based material. Moreover, in order to reduce an offset force against the external heating belt 103, the metal-made core member may have its outer peripheral surface coated with fluorine resin or the like. The first external heating roller 104 and the second external heating roller 105 are made identical in diameter with each other. The first external heating roller 104 and the second external heating roller 105 are symmetrically arranged with respect to a line connecting the center of axis of the fixing roller 101 and the center of the fixing nip region N1. In this way, the first external heating roller 104 and the second external heating roller 105 have the same configuration and are symmetrically arranged with respect to the line connecting the center of axis of the fixing roller 101 and the center of the fixing nip region N1 where the fixing roller 101 and the pressure roller 102 are in contact with each other. This makes it possible to form a uniform heating nip region N2 where the external heating belt 103 and the fixing roller 101 are in contact with each other, wherefore the fixing nip region N1 can be heated evenly.

Moreover, the sum of the stiffnesses of the first external heating roller 104 and the second external heating roller 105 is greater than or equal to the stiffness of the fixing roller 101. For example, given the stiffness of the fixing roller 101 (represented by σ×M) of $2.32\times10^7$, then the sum of the stiffnesses of the first external heating roller 104 and the second external heating roller 105 (represented by σ×M) is $2.54\times10^7$. By doing so, it is possible to raise a reaction force exerted on the fixing roller 101 via the first external heating roller 104 and the second external heating roller 105 against a fixing load applied from the pressure roller 102 to a level that permits suppression of deflection in the fixing roller 101. This makes it possible to obtain a satisfactory effect of suppressing the deflection of the fixing roller 101 and thereby attain excellent fixability and paper conveyance capability.

There is no particular limitation to the dimensional relationship among the diameters of the first external heating roller 104, the second external heating roller 105, and the fixing roller 101 (metal-core outer diameters 104*a*, 105*a*, and 101*a*). It is essential only that the sum of the stiffnesses of the first external heating roller 104 and the second external heating roller 105 be greater than or equal to the stiffness of the fixing roller 101.

Inside the first external heating roller 104 is disposed the first heater lamp 106 acting as a heat source for heating the first external heating roller 104 from within. Inside the second external heating roller 105 is disposed the second heater lamp 107 acting as a heat source for heating the second external heating roller 105 from within. The control circuit (not shown) effects control of the power circuit (not shown) in a manner so as to supply power to the first heater lamp 106 and the second heater lamp 107, whereby the first heater lamp 106 and the second heater lamp 107 are allowed to emanate light to cause infrared ray emission. Then, the inner peripheral surfaces of the first external heating roller 104 and the second external heating roller 105 are heated through infrared ray absorption. The first external heating roller 104 and the second external heating roller 105 in a heated state apply heat to the external heating belt 103.

The external heating belt 103 is disposed upstream of the fixing nip region N1 with respect to a direction in which the fixing roller 101 is rotated. The external heating belt 103 is brought into pressure-contact with the fixing roller 101 under a predetermined pressing load, for example, 176 N. A description as to an external heating belt unit acting as a mechanism for bringing the external heating belt 103 into pressure-contact with the fixing roller 101 will be given later on. Between the external heating belt 103 and the fixing roller 101 is formed the heating nip region N2 where the external heating belt 103 and the fixing roller 101 are in contact with each other. As the fixing roller 101 is rotated, the external heating belt 103 turns dependently with the rotation of the fixing roller 101. In accompaniment therewith, the first external heating roller 104 and the second external heating roller 105 are rotated dependently with the turning of the external heating belt 103. The inner peripheral surface of the external heating belt 103 is heated to a predetermined temperature, for example, 220° C. by the first external heating roller 104 and the second external heating roller 105. The fixing roller 101 is heated via the external heating belt 103. A heating nip width, which is the width of the heating nip region N2 in a direction in which the fixing roller 101 is rotated, is so determined that the external heating belt 103 is able to heat the fixing roller 101 adequately and the external heating belt 103 is allowed to turn dependently with the rotation of the fixing roller 101. For example, the heating nip width is set at 20 mm.

In the vicinity of the outer peripheral surface of the external heating belt 103 is disposed the first thermistor 109 acting as a temperature sensor for detecting a surface temperature of the external heating belt 103. In the vicinity of the outer peripheral surface of the fixing roller 101 is disposed the second thermistor 110 acting as a temperature sensor for detecting a surface temperature of the fixing roller 101.

The first thermistor 109 and the second thermistor 110 each serve as a temperature detecting section. Detected temperature data is provided to the control circuit (not shown) having the function of a temperature control section. On the basis of the temperature data, the control circuit controls power supply for the first heater lamp 106, the second heater lamp 107, and the third heater lamp 108 so as for the temperatures of the fixing roller 101 and the external heating belt 103 to reach predetermined levels.

For example, each of the heater lamps is controlled by the control circuit in the following manner. During warm-up period of time and fixation period of time as well, the first heater lamp 106 and the second heater lamp 107 are used prior to the use of other heater lamp until each heater lamp reaches its preset temperature. At this time, the preset temperature of the first heater lamp 106 and that of the second heater lamp 107 are each 220° C., whereas the preset temperature of the third heater lamp 108 is 190° C. On the other hand, during standby period of time, the third heater lamp 108 is used prior to the use of other heater lamp until each heater lamp reaches its preset temperature. At this time, the preset temperatures of the first heater lamp 106, the second heater lamp 107, and the third heater lamp 108 are each 190° C. In either case, only one of the group of the first and second heater lamps 106, 107 and the third heater lamp 108 is placed in a power-ON state. For example, during warm-up period of time, when the first heater lamp 106 and the second heater lamp 107 are in an ON state, the third heater lamp 108 is in an OFF state. Moreover, when the first heater lamp 106 and the second heater lamp 107 are in an OFF state and the temperature of the third heater lamp 108 is still below the preset temperature, the third heater lamp 108 is placed in an ON state.

Figure 2:
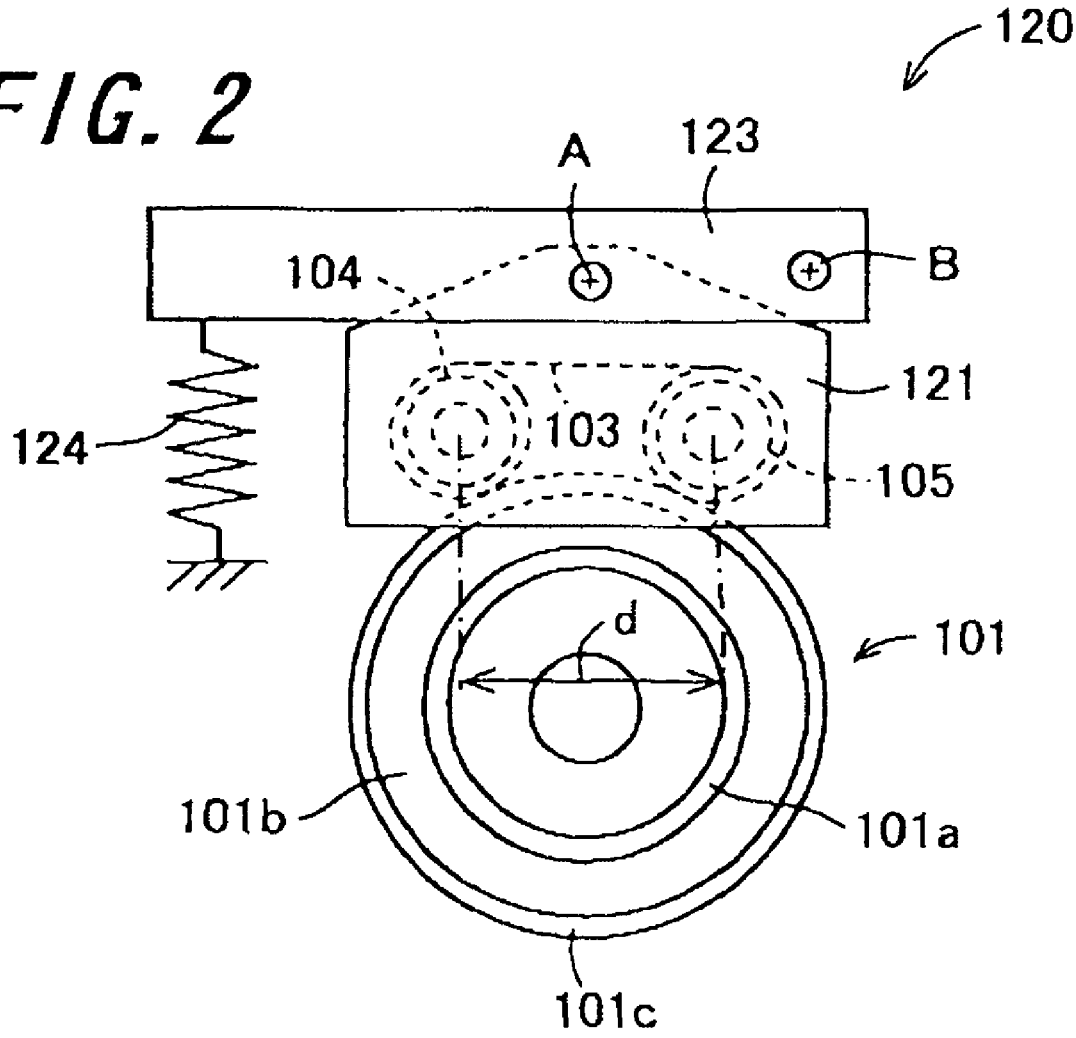
FIG. 2 is a front view showing the structure of an external heating belt unit.

Next, with reference to FIGS. 2 and 3, the structure of an external heating belt unit 120, which acts as a mechanism for bringing the external heating belt 103 into pressure-contact with the fixing roller 101, will be described in detail. FIG. 2 is a front view showing the structure of the external heating belt unit 120, and FIG. 3 is a top view showing the structure of the external heating belt unit 120.

Figure 3:
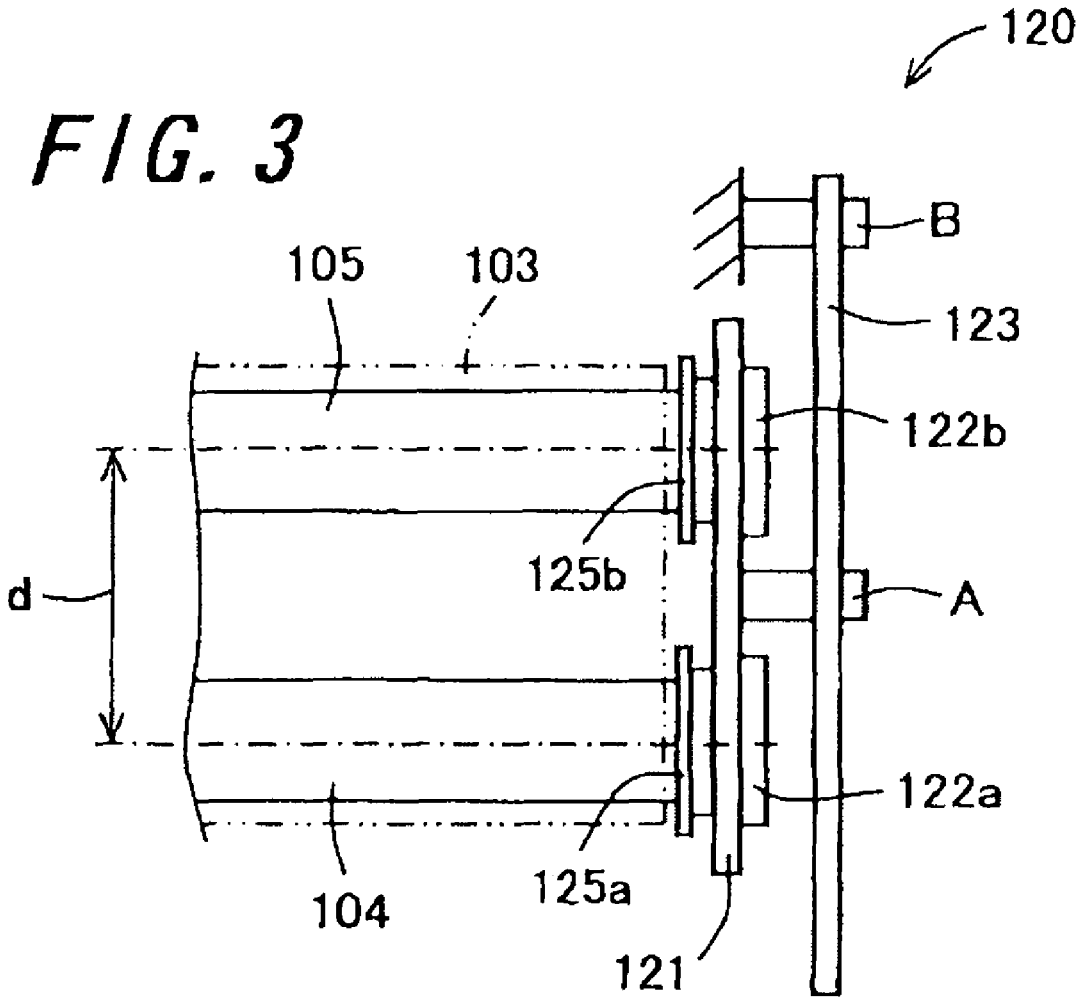
FIG. 3 is a top view showing the structure of the external heating belt unit.

As shown in FIGS. 2 and 3, the external heating belt unit 120 comprises a side frame 121, bearings 122*a* and 122*b*, an arm 123, a coil spring 124, and offset regulating members 125*a* and 125*b*.

The side frame 121, which is a plate-like member formed for example of a steel plate, is provided with the bearings 122*a* and 122*b* for rotatably supporting one end of the first external heating roller 104 and one end of the second external heating roller 105.

The bearings 122*a* and 122*b* are each formed of a member made of a plastic material such for example as PPS (polyphenylene sulfide) resin. The bearings 122*a* and 122*b* are spacedly fixed to the side frame 121, with a predetermined center-to-center distance of d, so that the first external heating roller 104 and the second external heating roller 105 can be arranged in parallel with each other. With this arrangement, parallelism can be secured between the first external heating roller 104 and the second external heating roller 105. It is preferable that a parallelism tolerance for the first external heating roller 104 and the second external heating roller 105 is smaller than or equal to 100 μm.

Note that, although there are shown in FIG. 3 only the structures of one side of the first external heating roller 104 and one side of the second external heating roller 105, the other sides thereof are each constructed similarly.

The side frame 121 is supported via a shaft on the arm 123 so as to be rotatable about a fulcrum point A located in a midportion of the upper part of the side frame 121. The arm 123, which is a plate-like member formed for example of a steel plate, is supported via a shaft so as to be rotatable about a fulcrum point B located in an end portion of the arm 123. Moreover, the coil spring 124 is attached to another one end portion of the arm 123 opposite from the fulcrum point B. The coil spring 124 imparts a load to the one end portion of the arm 123 thereby to urge the side frame 121 attached to the arm 123 in a direction toward the fixing roller 101. In consequence, the first external heating roller 104 and the second external heating roller 105 supported by the bearings 122*a* and 122*b* of the side frame 121 are brought into pressure-contact with the fixing roller 101, with the external heating belt 103 lying therebetween, under the same load.

In the vicinity of each end of the first external heating roller 104 is disposed the offset regulating member 125*a*. Also in the vicinity of each end of the second external heating roller 105 is disposed the offset regulating member 125*b*. The offset regulating members 125*a* and 125*b* are provided to prevent meandering of the external heating belt 103. The offset regulating members 125*a* and 125*b*, of which each is a ring-shaped member formed of a plastic material such for example as PPS resin, are disposed between the bearing 122*a* and the external heating belt 103 and between bearing 122*b* and the external heating belt 103, respectively, so as to be convexly curved radially outwardly of the first external heating roller 104 and the second external heating roller 105, respectively. Surface portions of the offset regulating members 125*a* and 125*b* facing the external heating belt 103 are kept in face-to-face contact with a surface portion of the external heating belt 103 near the widthwise end thereof, and are thus rotated dependently with the turning of the external heating belt 103. With this arrangement, when the external heating belt 103 winds its way, it is possible to regulate its offset in the direction of the axes of the first external heating roller 104 and the second external heating roller 105. In addition to that, the external heating belt 103 can be protected from abrasion and cracking induced by the sliding action of its widthwise ends.

While, in the preceding embodiment, the recording sheet P is used as a recording material, there is no particular limitation. Any other recording material may be used instead so long as it is conveyable in the fixing nip region N1 between the fixing roller 101 and the pressure roller 102.

Second Embodiment

Figure 4:
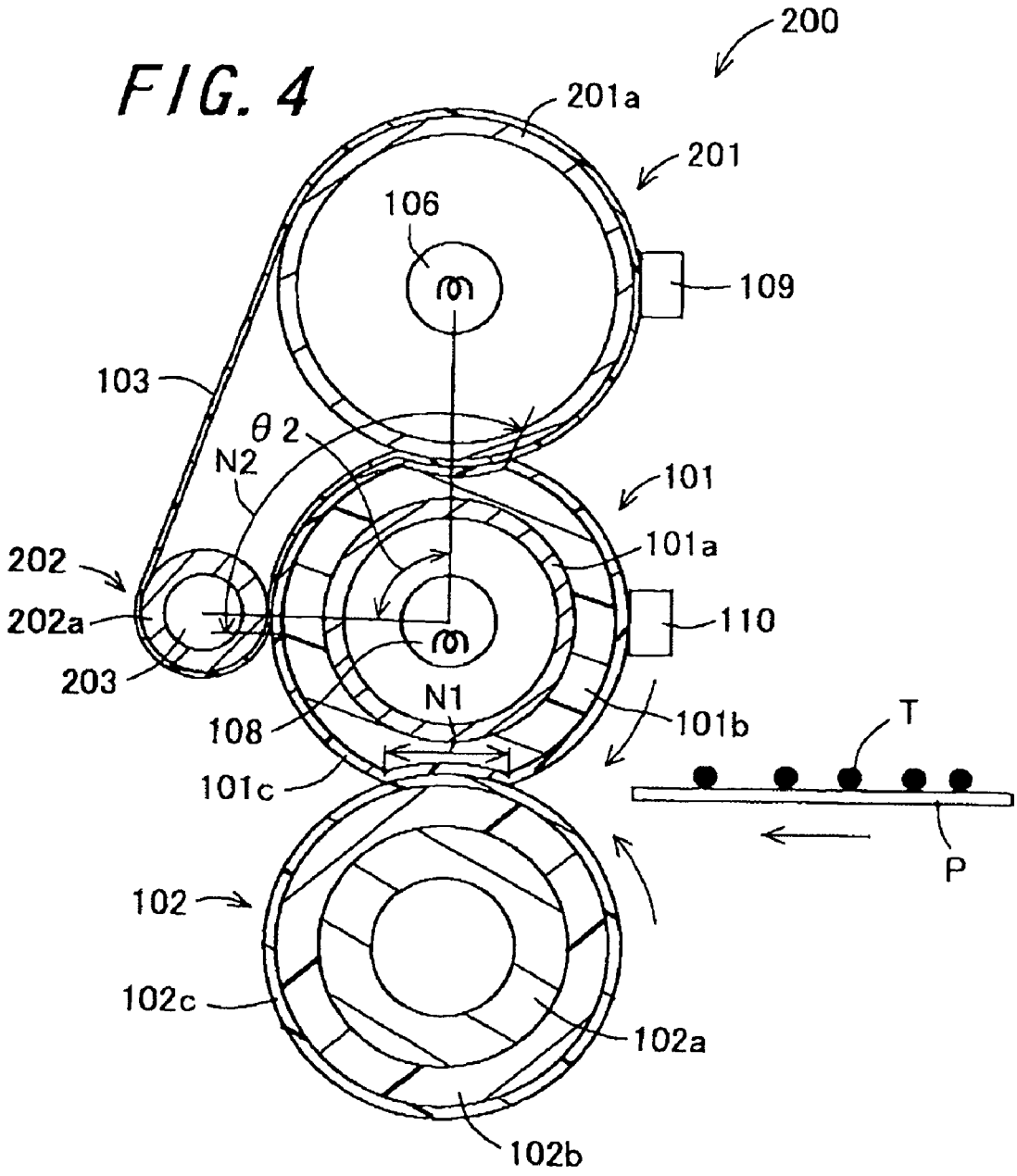
FIG. 4 is a sectional view showing the structure of the fixing apparatus in accordance with a second embodiment of the invention in simplified form.

FIG. 4 is a sectional view showing the structure of a fixing apparatus 200 in accordance with a second embodiment of the invention in simplified form. In the fixing apparatus 200 of the second embodiment of the invention, the constituent components corresponding to those of the fixing apparatus 100 of the first embodiment will be identified with the same reference symbols, and overlapping descriptions will be omitted.

As shown in FIG. 4, the fixing apparatus 200 comprises: a fixing roller 101 and a pressure roller 102 constituting a pair of fixing members, which are brought into contact with each other under pressure; an external heating belt 103 designed as an endless belt for heating the surface of the fixing roller 101 externally; a first external heating roller 201 and a second external heating roller 202 for heating and suspending the external heating belt 103 in a tensioned state; a first heater lamp 106 acting as a heat source for heating the first external heating roller 201; a first heat pipe 203 acting as a temperature equalizing section for making the temperature of the second external heating roller 202 uniform; a third heater lamp 108 acting as a heat source for heating the fixing roller 101 from within; a first thermistor 109 acting as a temperature sensor for detecting a surface temperature of the external heating belt 103; and a second thermistor 110 acting as a temperature sensor for detecting a surface temperature of the fixing roller 101. The first external heating roller 201 and the second external heating roller 202 correspond to a plurality of first external heating members.

The fixing apparatus 200 implemented by way of the second embodiment of the invention differs from the fixing apparatus 100 of the first embodiment of the invention in the first external heating roller 201, the second external heating roller 202, and the first heat pipe 203.

The external heating belt 103 is turnably laid, in a tensioned state, across the first external heating roller 201 and the second external heating roller 202 that are so arranged as to touch internally the external heating belt 103 to effect application of heat. The first external heating roller 201 and the second external heating roller 202 are so arranged as to be rotatable about two axes substantially parallel to the axis of the fixing roller 101 and the axis of the pressure roller 102, respectively.

In the vicinity of the outer peripheral surface of the fixing roller 101, the first external heating roller 201 is disposed in such a manner that, out of the two angles that a direction in which a straight line segment connecting the center of the first external heating roller 201 and the center of the fixing roller 101 extends forms with the angular reference direction, the smaller one, namely the mounting angle θ1, is 0°. That is, the first external heating roller 201 is located immediately above the fixing roller 101 and opposite the fixing nip region N1 with respect to the axis of the fixing roller 201.

Thus, one of a plurality of (two pieces of, in this case) the first external heating members, namely the first external heating roller 201, is placed at a suitable position so that occurrence of deflection in the fixing roller 101 can be suppressed most effectively. With this arrangement, there is no need to impart a function of suppressing the deflection of a fixing roller 101 to the other first external heating member, namely the second external heating roller 202. This makes it possible to provide another additional function, for example, a heat-conductive function, and thereby produce a fixing apparatus having higher performance capability.

Moreover, in the vicinity of the outer peripheral surface of the fixing roller 101, the second external heating roller 202 is disposed in such a manner that, out of the two angles that a direction in which a straight line segment connecting the center of the second external heating roller 202 and the center of the fixing roller 101 extends forms with the angular reference direction, the smaller one, namely the mounting angle θ2, is 90°. That is, the second external heating roller 202 is located right beside the fixing roller 101.

In this way, out of a plurality of (two pieces of, in this case) the first external heating members, one first external heating member, namely the first external heating roller 201 is placed at a suitable position so that occurrence of deflection in the fixing roller 101 can be suppressed most effectively, and the other first external heating member, namely the second external heating roller 202 is placed at a suitable position so that a sufficiently large heating nip width can be obtained. With this arrangement, it is possible to suppress the deflection of the fixing roller 101 without impairing the efficiency in heating of the fixing roller 101.

Moreover, the first external heating roller 201 and the second external heating roller 202 are spaced apart to provide a center-to-center distance of, for example, 26 mm. The first external heating roller 201 and the second external heating roller 202 are arranged in contact with the outer peripheral surface of the fixing roller 101.

The external heating belt 103 is, in a natural state, stretched under a tension of a level that prevents the external heating belt 103 from being inadvertently displaced in the axial direction of the first external heating roller 201, as well as the axial direction of the second external heating roller 202.

For example, the first external heating roller 201 and the second external heating roller 202 are composed of hollow cylindrical metal-made core members 201*a* and 202*a*, respectively, that are made for example of aluminum and an iron-based material. Moreover, in order to reduce an offset force against the external heating belt 103, the metal-made core member 201*a*, 202*a* may have its outer peripheral surface coated with fluorine resin or the like.

Further, the sum of the stiffnesses of the first external heating roller 201 and the second external heating roller 202 is set to be greater than or equal to the stiffness of the fixing roller 101. For example, given the stiffness of the fixing roller 101 (represented by σ×M) of $2.32\times10^7$, then the sum of the stiffnesses of the first external heating roller 201 and the second external heating roller 202 (represented by σ×M) is $2.53\times10^7$. By doing so, it is possible to raise a reaction force exerted on the fixing roller 101 via the first external heating roller 201 and the second external heating roller 202 against a fixing load applied from the pressure roller 102 to a level that permits suppression of deflection in the fixing roller 101. This makes it possible to obtain a satisfactory effect of suppressing the deflection of the fixing roller 101 and thereby attain excellent fixability and paper conveyance capability.

There is no need to impart a function of suppressing the deflection of the fixing roller 101 to the second external heating roller 202. In this regard, the second external heating roller 202 should preferably be formed of the core member 202*a* made of an aluminum-based material. By doing so, the second external heating roller 202 can be made higher in longitudinal thermal conduction than the first external heating roller 201.

That is, it is preferable that, out of a plurality of first external heating members, the one other than the first external heating member which is disposed, in the vicinity of the outer peripheral surface of the fixing roller 101, so as to be located opposite the fixing nip region N1 with respect to the axis of the fixing roller 101, namely the second external heating roller 202, is made higher in longitudinal thermal conduction than the first external heating roller 201 which is disposed, in the vicinity of the outer peripheral surface of the fixing roller 101, so as to be located opposite the fixing nip region N1.

The difference in thermal conduction can be created by varying the materials of construction or the sizes of the external heating rollers, or by using an auxiliary member for thermal conduction enhancement.

In this way, the longitudinal thermal conduction of the second external heating roller 202 can be enhanced, wherefore the degree of temperature variation in the direction of the width of the external heating belt 103, as well as in the direction longitudinally of the fixing roller 101, can be decreased. Accordingly, even if recording sheets whose widths are smaller than the length of the longer side of the fixing roller 101 are fed one after another, it never occurs that the non-paper-passing region of the fixing roller 101 undergoes abnormal temperature elevation. This makes it possible to suppress occurrence of temperature rise in the non-paper-passing region.

The outer diameter of the first external heating roller 201 is adjusted to be approximately two to three times larger than the outer diameter of the second external heating roller 202. By doing so, the stiffness of the first external heating roller 201 is greater than the stiffness of the second external heating roller 202.

Thus, out of a plurality of (two pieces of, in this case) the first external heating members, the one which is disposed, in the vicinity of the outer peripheral surface of the fixing roller 101, so as to be located opposite the fixing nip region N1 with respect to the axis of the fixing roller 101, namely the first external heating roller 201 exhibits the highest stiffness. This makes it possible to increase a reaction force developed against a fixing load via the first external heating member effectively, and thereby suppress occurrence of deflection in the fixing roller 101 more reliably.

While, in the construction thus far described, the first external heating roller 201 is designed to have a larger outer diameter, namely a larger geometrical moment of inertia, to obtain a stiffness greater than the stiffness of the second external heating roller 202, there is no particular limitation. For example, the first external heating roller 201 may be formed of a metal-made core member having a Young's modulus σ larger than that of the material used for the second external heating roller 202. In this case, for example, as the first external heating roller 201, a member formed of a carbon steel (STKM)-made core member may be used, whereas as the second external heating roller 202, a member formed of an aluminum-made core member may be used.

Moreover, the first external heating roller 201 is designed to have a so-called crown shape in which, when viewed in the direction longitudinally thereof, the outer diameter at its midportion is, for example, approximately 0.4% to 1% larger than the outer diameter at its opposite ends.

Thus, at least one of a plurality of (two pieces of, in this case) the first external heating members is formed in a crown shape. This makes it possible to exert, on the longitudinal midportion of the fixing roller 101 that may undergo deflection to the highest degree, a reaction force to cope with a larger fixing load, and thereby suppress occurrence of deflection in the fixing roller 101 more effectively.

Inside the first external heating roller 201 is disposed the first heater lamp 106 acting as a heat source for heating the first external heating roller 201 from within. The control circuit (not shown) effects control of the power circuit (not shown) in a manner so as to supply power to the first heater lamp 106, whereby the first heater lamp 106 is allowed to emanate light to cause infrared ray emission. Then, the inner peripheral surface of the first external heating roller 201 is heated through infrared ray absorption. The first external heating roller 201 in a heated state applies heat to the external heating belt 103.

Inside the second external heating roller 202 is disposed the first heat pipe 203 acting as a temperature equalizing section for making the temperature of the second external heating roller 202 uniform. The first heat pipe 203 has a condensate fluid (not shown) hermetically sealed in its interior part for delivering heat from a high-temperature region to a low-temperature region. In addition, the first heat pipe 203 has formed on its inner peripheral surface a wick (not shown) for returning the condensate fluid from the low-temperature region to the high-temperature region by exploiting a capillary phenomenon. Note that "the high-temperature region" refers to the opposite ends of the second external heating roller 202, and "the low-temperature region" refers to the midportion of the second external heating roller 202.

Thus, out of a plurality of (two pieces of, in this case) the first external heating members, the one other than the first external heating member which is disposed, in the vicinity of the outer peripheral surface of the fixing roller 101, so as to be located opposite the fixing nip region N1 with respect to the axis of the fixing roller 101, namely the second external heating roller 202, is provided with the heat pipe extending along the direction longitudinally thereof. This makes it possible to enhance the longitudinal thermal conduction of the second external heating roller 202 without fail, and thereby reduce temperature variation in the direction of the width of the external heating belt 103, as well as in the direction longitudinally of the fixing roller 101 without fail.

Moreover, the second external heating roller 202 has not a heat source. In this case, for example, in order to provide another function such as thermal conduction, the second external heating roller 202 may be designed to have a solid-core configuration or may be formed of a metal core made of an aluminum-based material. Accordingly, a fixing apparatus having higher performance capability can be produced.

The external heating belt 103 is disposed upstream of the fixing nip region N1 with respect to the direction in which the fixing roller 101 is rotated. The external heating belt 103 is brought into pressure-contact with the fixing roller 101 under a predetermined pressing load, for example, 176 N. An external heating belt unit acting as a mechanism for bringing the external heating belt 103 into pressure-contact with the fixing roller 101 is similar in construction to the external heating belt unit 120 employed in the fixing apparatus 100 of the first embodiment.

As the fixing roller 101 is rotated, the external heating belt 103 turns dependently with the rotation of the fixing roller 101. In accompaniment therewith, the first external heating roller 201 and the second external heating roller 202 are rotated dependently with the turning of the external heating belt 103. The inner peripheral surface of the external heating belt 103 is heated to a predetermined temperature, for example, 220° C. by the first external heating roller 201. The fixing roller 101 is heated via the external heating belt 103. The heating nip width of the heating nip region N2 is so determined that the external heating belt 103 is able to heat the fixing roller 101 adequately and the external heating belt 103 is allowed to turn dependently with the rotation of the fixing roller 101 properly. For example, the heating nip width is set at 20 mm.

The first thermistor 109 and the second thermistor 110 each serve as a temperature detecting section Detected temperature data is provided to the control circuit (not shown) having the function of a temperature control section. On the basis of the temperature data, the control circuit controls power supply for the first heater lamp 106 and the third heater lamp 108 so as for the temperatures of the fixing roller 101 and the external heating belt 103 to reach predetermined levels.

For example, each of the heater lamps is controlled by the control circuit in the following manner. During warm-up period of time and fixation period of time as well, the first heater lamp 106 is used prior to the use of other heater lamp until each heater lamp reaches its preset temperature. At this time, the preset temperature of the first heater lamp 106 is 220° C., whereas the preset temperature of the third heater lamp 108 is 190° C. On the other hand, during standby period of time, the third heater lamp 108 is used prior to the use of other heater lamp until each heater lamp reaches its preset temperature. At this time, the preset temperatures of the first heater lamp 106 and the third heater lamp 108 are each 190° C. In either case, only one of the first heater lamp 106 and the third heater lamp 108 is placed in a power-ON state. For example, during warm-up period of time, when the first heater lamp 106 is in an ON state, the third heater lamp 108 is in an OFF state. Moreover, when the first heater lamp 106 is in an OFF state and the temperature of the third heater lamp 108 is still below the preset temperature, the third heater lamp 108 is placed in an ON state.

As described heretofore, the fixing apparatus 100 of the first embodiment of the invention, as well as the fixing apparatus 200 of the second embodiment of the invention, comprises a pair of fixing members consisting of the fixing roller 101 and the pressure roller 102 kept in contact with each other under pressure; the external heating belt 103 for heating the surface of the fixing roller 101 externally; and the first external heating roller 104 (201) having a heat source and the second external heating roller 105 (202) for allowing the external heating belt 103 to be suspended in a tensioned state. In this construction, the sum of the stiffnesses of the first external heating roller 104 (201) and the second external heating roller 105 (202) is greater than or equal to the stiffness of the fixing roller 101.

By virtue of the features described hereinabove, even if the process speed is increased, the fixing apparatus 100 and the fixing apparatus 200 are each excellent in terms of fixing roller 101's temperature follow-up capability, fixability, paper conveyance capability, and energy conservation.

In the fixing apparatus 200, by setting the diameter of the first external heating roller 201 (the outer diameter of the core member 201*a*) to be larger than or equal to the diameter of the fixing roller 101 (the outer diameter of the metal core 101*a*), it is possible to achieve a full effect. In regard to the position of the first external heating roller 201 relative to the fixing roller 101 (the position of a center of axle of the first external heating roller 201), the first external heating roller 201 may possibly be shifted from the position of a vertical line including the axis of the fixing roller 101. Therefore, the position of the first external heating roller 201 relative to the fixing roller 101 is adjusted properly so that subsequently-described warm-up period of time, temperature follow-up capability, fixability, and paper conveyance capability fulfill predetermined conditions.

Third Embodiment

Figure 5:
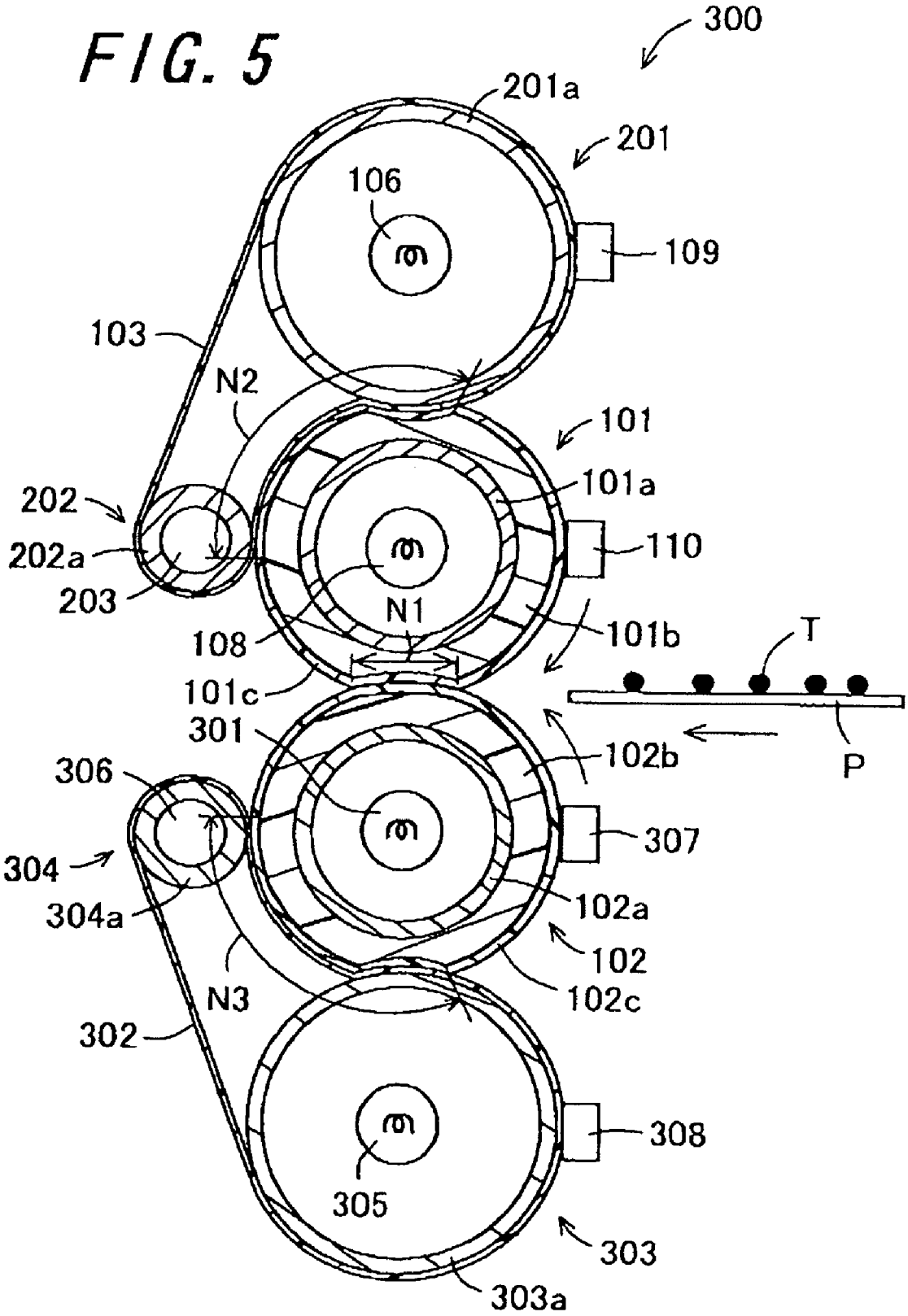
FIG. 5 is a sectional view showing the structure of the fixing apparatus in accordance with a third embodiment of the invention in simplified form.

FIG. 5 is a sectional view showing the structure of a fixing apparatus 300 in accordance with a third embodiment of the invention in simplified form. In the fixing apparatus 300 of the third embodiment of the invention, the constituent components corresponding to those of the fixing apparatus 100 of the first embodiment and the fixing apparatus 200 of the second embodiment will be identified with the same reference symbols, and overlapping descriptions will be omitted.

As shown in FIG. 5, the fixing apparatus 300 comprises: a fixing roller 101 and a pressure roller 102 constituting a pair of fixing members, which are brought into contact with each other under pressure; an external heating belt 103 designed as an endless belt for heating the surface of the fixing roller 101 externally; a first external heating roller 201 and a second external heating roller 202 for heating and suspending the external heating belt 103 in a tensioned state; a first heater lamp 106 acting as a heat source for heating the first external heating roller 201; a first heat pipe 203 acting as a temperature equalizing section for making the temperature of the second external heating roller 202 uniform; a third heater lamp 10B acting as a heat source for heating the fixing roller 101 from within; a fourth heater lamp 301 acting as a heat source for heating the pressure roller 102 from within; an external heating belt 302 designed as an endless belt for heating the surface of the pressure roller 102 externally; a third external heating roller 303 and a fourth external heating roller 304 for heating and suspending the external heating belt 302 in a tensioned state; a fifth heater lamp 305 acting as a heat source for heating the third external heating roller 303; a second heat pipe 306 acting as a temperature equalizing section for making the temperature of the fourth external heating roller 304 uniform; a first thermistor 109 acting as a temperature sensor for detecting a surface temperature of the external heating belt 103; a second thermistor 110 acting as a temperature sensor for detecting a surface temperature of the fixing roller 101; a third thermistor 307 acting as a temperature sensor for detecting a surface temperature of the pressure roller 102; and a fourth thermistor 308 acting as a temperature sensor for detecting a surface temperature of the external heating belt 302. The external heating belt 302 corresponds to the second external heating belt. The third external heating roller 303 and the fourth external heating roller 304 correspond to a plurality of second external heating members.

The fixing apparatus 300 implemented by way of the third embodiment of the invention differs from the fixing apparatus 200 of the second embodiment of the invention in the fourth heater lamp 301, the external heating belt 302, the third external heating roller 303, the fourth external heating roller 304, the fifth heater lamp 305, the second heat pipe 306, the third thermistor 307, and the fourth thermistor 308.

The pressure roller 102 is similar in construction to the fixing roller 101. Inside the pressure roller 102 is disposed the fourth heater lamp 301 acting as a heat source for heating the pressure roller 102 from within. The control circuit (not shown) effects control of the power circuit (not shown) in a manner so as to supply power to the fourth heater lamp 301, whereby the fourth heater lamp 301 is allowed to emanate light to cause infrared ray emission. Then, the inner peripheral surface of the pressure roller 102 is heated through infrared ray absorption, and eventually the pressure roller 102 can wholly be heated. In consequence, the pressure roller 102 is heated to a predetermined temperature, for example, 140° C. thereby to heat the recording sheet P having formed thereon the unfixed toner image T that passes through the fixing nip region N1.

Thus, in the presence of the heat source disposed on the pressure-roller 102 side, in the fixing apparatus 300, even if the process speed is increased even further, the temperature of the pressure roller can be maintained at a level adaptable to the increase of the process speed. This makes it possible to produce a fixing apparatus that offers excellent temperature follow-up capability and fixability.

The external heating belt 302 designed as an endless belt is turnably laid, in a tensioned state, across the third external heating roller 303 and the fourth external heating roller 304 that are so arranged as to touch internally the external heating belt 302 to effect application of heat. The third external heating roller 303 and the fourth external heating roller 304 are so arranged as to be rotatable about two axes substantially parallel to the axis of the fixing roller 101 and the axis of the pressure roller 102, respectively.

In the vicinity of the outer peripheral surface of the pressure roller 102, the third external heating roller 303 is disposed in such a manner that, out of the two angles that a direction in which a straight line segment connecting the center of the third external heating roller 303 and the center of the pressure roller 102 extends forms with the angular reference direction, the smaller one, namely the mounting angle θ1, is 0°. That is, the third external heating roller 303 is located immediately below the pressure roller 102 and opposite the fixing nip region N1 with respect to the axis of the pressure roller 102.

Thus, one of a plurality of (two pieces of, in this case) the second external heating members, namely the third external heating roller 303, is placed at a suitable position so that occurrence of deflection in the pressure roller 102 can be suppressed most effectively. With this arrangement, there is no need to impart a function of suppressing the deflection of the pressure roller 102 to the other second external heating member, namely the fourth external heating roller 304. This makes it possible to provide another additional function, for example, a heat-conductive function, and thereby produce a fixing apparatus having higher performance capability.

Moreover, in the vicinity of the outer peripheral surface of the pressure roller 102, the fourth external heating roller 304 is disposed in such a manner that, out of the two angles that a direction in which a straight line segment connecting the center of the fourth external heating roller 304 and the center of the pressure roller 102 extends forms with the angular reference direction, the smaller one, namely the mounting angle θ2, is 90'. That is, the fourth external heating roller 304 is located right beside the pressure roller 102.

In this way, out of a plurality of (two pieces of, in this case) the second external heating members, one second external heating member, namely the third external heating roller 303 is placed at a suitable position so that occurrence of deflection in the pressure roller 102 can be suppressed most effectively, and the other second external heating member, namely the fourth external heating roller 304 is placed at a suitable position so as to obtain a sufficiently large heating nip width N3 in a region where the external heating belt 302 and the pressure roller 102 are in contact with each other. With this arrangement, it is possible to suppress the deflection of the pressure roller 102 without impairing the efficiency in heating of the pressure roller 102.

Moreover, the third external heating roller 303 and the fourth external heating roller 304 are spaced apart to provide a center-to-center distance of, for example, 26 mm. The third external heating roller 303 and the fourth external heating roller 304 are arranged in contact with the outer peripheral surface of the pressure roller 102.

The external heating belt 302 is, in a natural state, stretched under a tension of a level that prevents the external heating belt 302 from being inadvertently displaced in the axial direction of the third external heating roller 303, as well as the axial direction of the fourth external heating roller 304. The external heating belt 302 is disposed, with its outer peripheral surface, namely a surface facing the pressure roller 102 brought into contact with the outer peripheral surface of the pressure roller 102.

The external heating belt 302, which is similar in construction to the external heating belt 103, is designed in a two-layer construction; that is, constructed by forming, on a surface of a hollow cylindrical base material made of heat-resistant resin such as polyimide or a metal material such as stainless and nickel, a layer acting as a release layer made of a synthetic resin material offering excellent heat resistance and mold releasability, for example, a layer made of fluorine resin such as PFA and PTFE. Moreover, in order to reduce an offset force against the external heating belt 302, namely a force exerted on the external heating belt 302 to cause it to move in a direction perpendicular to a direction in which the external heating belt 302 turns, the belt base material may have its inner peripheral surface coated with fluorine resin or the like.

The third external heating roller 303 and the fourth external heating roller 304 are similar in construction to the first external heating roller 201 and the second external heating roller 202, respectively. For example, the third external heating roller 303 and the fourth external heating roller 304 are composed of hollow cylindrical metal-made core members 303*a* and 304*a*, respectively, that are made for example of aluminum and an iron-based material. Moreover, in order to reduce an offset force against the external heating belt 302, the metal-made core member 303*a*, 304*a* may have its outer peripheral surface coated with fluorine resin or the like.

There is no need to impart a function of suppressing the deflection of the pressure roller 102 to the fourth external heating roller 304. In this regard, the fourth external heating roller 304 should preferably be formed of the core member 304*a* made of an aluminum-based material. By doing so, it is possible to enhance the longitudinal thermal conduction of the fourth external heating roller 304.

That is, it is preferable that, out of a plurality of second external heating members, the one other than the second external heating member which is disposed, in the vicinity of the outer peripheral surface of the pressure roller 102, so as to be located opposite the fixing nip region N1 with respect to the axis of the pressure roller 102, namely the fourth external heating roller 304, is made higher in longitudinal thermal conduction than the third external heating roller 303 which is disposed, in the vicinity of the outer peripheral surface of the pressure roller 102, so as to be located opposite the fixing nip region N1.

In this way, the longitudinal thermal conduction of the fourth external heating roller 304 can be enhanced, wherefore the degree of temperature variation in the direction of the width of the external heating belt 302, as well as in the direction longitudinally of the pressure roller 102, can be decreased. Accordingly, even if recording sheets whose widths are smaller than the length of the longer side of the pressure roller 102 are fed one after another, it never occurs that the non-paper-passing region of the pressure roller 102 undergoes abnormal temperature elevation. This makes it possible to suppress occurrence of temperature rise in the non-paper-passing region.

The difference in thermal conduction can be created by varying the materials of construction or the sizes of the external heating rollers, or by using an auxiliary member for thermal conduction enhancement.

The outer diameter of the third external heating roller 303 is set to be approximately two to three times larger than the outer diameter of the fourth external heating roller 304. By doing so, the stiffness of the third external heating roller 303 is greater than the stiffness of the fourth external heating roller 304.

Thus, out of a plurality of (two pieces of, in this case) the second external heating members, the one which is disposed, in the vicinity of the outer peripheral surface of the pressure roller 102, so as to be located opposite the fixing nip region N1 with respect to the axis of the pressure roller 102, namely the third external heating roller 303 exhibits the highest stiffness. This makes it possible to increase a reaction force developed against a fixing load via the second external heating member more effectively, and thereby suppress occurrence of deflection in the pressure roller 102 more reliably.

While, in the construction thus far described, the third external heating roller 303 is designed to have a larger outer diameter, namely a larger geometrical moment of inertia, to obtain a stiffness greater than the stiffness of the fourth external heating roller 304, there is no particular limitation. The third external heating roller 303 may be formed of a metal-made core member having a Young's modulus σ larger than that of the material used for the fourth external heating roller 304. In this case, for example, as the third external heating roller 303, a member formed of a carbon steel (STKM)-made core member may be used, whereas as the fourth external heating roller 304, a member formed of an aluminum-made core member may be used.

Moreover, the third external heating roller 303 is designed to have a crown shape in which, when viewed in the direction longitudinally thereof, the outer diameter at its midportion is, for example, approximately 0.4% to 1% larger than the outer diameter at its opposite ends.

Thus, at least one of a plurality of (two pieces of, in this case) the second external heating members is formed in a crown shape. This makes it possible to exert, on the longitudinal midportion of the pressure roller 102 that may undergo deflection to the highest degree, a reaction force to cope with a larger fixing load, and thereby suppress occurrence of deflection in the pressure roller 102 more effectively.

Inside the third external heating roller 303 is disposed the fifth heater lamp 305 acting as a heat source for heating the third external heating roller 303 from within. The control circuit (not shown) effects control of the power circuit (not shown) in a manner so as to supply power to the fifth heater lamp 305, whereby the fifth heater lamp 305 is allowed to emanate light to cause infrared ray emission. Then, the inner peripheral surface of the third external heating roller 303 is heated through infrared ray absorption. The third external heating roller 303 in a heated state applies heat to the external heating belt 302.

Inside the fourth external heating roller 304 is disposed the second heat pipe 306 acting as a temperature equalizing section for making the temperature of the fourth external heating roller 304 uniform. The second heat pipe 306 has a condensate fluid (not shown) hermetically sealed in its interior part for delivering heat from a high-temperature region to a low-temperature region. In addition, the second heat pipe 306 has formed on its inner peripheral surface a wick (not shown) for returning the condensate fluid from the low-temperature region to the high-temperature region by exploiting a capillary phenomenon. Note that "the high-temperature region" refers to the opposite ends of the fourth external heating roller 304, and "the low-temperature region" refers to the midportion of the fourth external heating roller 304.

Thus, out of a plurality of (two pieces of, in this case) the second external heating members, the one other than the second external heating member which is disposed, in the vicinity of the outer peripheral surface of the pressure roller 102, so as to be located opposite the fixing nip region N1 with respect to the axis of the pressure roller 102, namely the fourth external heating roller 304, is provided with the heat pipe extending along the direction longitudinally thereof. This makes it possible to enhance the longitudinal thermal conduction of the fourth external heating roller 304 without fail, and thereby reduce temperature variation in the direction of the width of the external heating belt 302, as well as in the direction longitudinally of the pressure roller 102 without fail.

Moreover, the fourth external heating roller 304 has not a heat source. In this case, for example, in order to provide another function such as thermal conduction, the fourth external heating roller 304 may be designed to have a solid-core configuration or may be formed of a metal core made of an aluminum-based material. Accordingly, a fixing apparatus having higher performance capability can be produced.

The external heating belt 302 is disposed upstream of the fixing nip region N1 with respect to the direction in which the pressure roller 102 is rotated. The external heating belt 302 is brought into pressure-contact with the pressure roller 102 under a predetermined pressing load, for example, 176 N. An external heating belt unit acting as a mechanism for bringing the external heating belt 302 into pressure-contact with the pressure roller 102 is similar in construction to the external heating belt unit 120 employed in the fixing apparatus 100 of the first embodiment.

Between the external heating belt 302 and the pressure roller 102 is formed a heating nip region N3 where the external heating belt 302 and the pressure roller 102 are in contact with each other.

As the pressure roller 102 is rotated, the external heating belt 302 turns dependently with the rotation of the pressure roller 102. In accompaniment therewith, the third external heating roller 303 and the fourth external heating roller 304 are rotated dependently with the turning of the external heating belt 302. The inner peripheral surface of the external heating belt 302 is heated to a predetermined temperature, for example, 220° C. by the third external heating roller 303. The pressure roller 102 is heated via the external heating belt 302. The heating nip width of the heating nip region N3 is so determined that the external heating belt 302 is able to heat the pressure roller 102 adequately and the external heating belt 302 is allowed to turn dependently with the rotation of the pressure roller 102 properly. For example, the heating nip width is set at 20 mm.

In the vicinity of the outer peripheral surface of the pressure roller 102 is disposed the third thermistor 307 acting as a temperature sensor for detecting a surface temperature of the pressure roller 102. In the vicinity of the outer peripheral surface of the external heating belt 302 is disposed the fourth thermistor 308 acting as a temperature sensor for detecting a surface temperature of the external heating belt 302.

The third thermistor 307 and the fourth thermistor 308 each serve as a temperature detecting section. Detected temperature data is provided to the control circuit (not shown) having the function of a temperature control section. On the basis of the temperature data, the control circuit controls power supply for the fourth heater lamp 301 and the fifth heater lamp 305 so as for the temperatures of the pressure roller 102 and the external heating belt 302 to reach predetermined levels.

For example, each of the heater lamps is controlled by the control circuit in the following manner. During warm-up period of time and fixation period of time as well, the fifth heater lamp 305 is used prior to the use of other heater lamp until each heater lamp reaches its preset temperature. At this time, the preset temperature of the fifth heater lamp 305 is 200° C., whereas the preset temperature of the fourth heater lamp 301 is 140° C. On the other hand, during standby period of time, the fourth heater lamp 301 is used prior to the use of other heater lamp until each heater lamp reaches its preset temperature. At this time, the preset temperatures of the fourth heater lamp 301 and the fifth heater lamp 305 are each 140° C. In either case, only one of the fourth heater lamp 301 and the fifth heater lamp 305 is placed in a power-ON state. For example, during warm-up period of time, when the fifth heater lamp 305 is in an ON state, the fourth heater lamp 301 is in an OFF state. Moreover, when the fifth heater lamp 305 is in an OFF state and the temperature of the fourth heater lamp 301 is still below the preset temperature, the fourth heater lamp 301 is placed in an ON state.

As described heretofore, the fixing apparatus 300 of the third embodiment of the invention comprises a pair of fixing members consisting of the fixing roller 101 and the pressure roller 102 kept in contact with each other under pressure; the external heating belt 103 for heating the surface of the fixing roller 101 externally; the first external heating roller 201 having a heat source and the second external heating roller 202 for allowing the external heating belt 103 to be suspended in a tensioned state; the external heating belt 302 for heating the surface of the pressure roller 102 externally; and the third external heating roller 303 having a heat source and the fourth external heating roller 304 for allowing the external heating belt 302 to be suspended in a tensioned state. In this construction, the sum of the stiffnesses of the third external heating roller 303 and the fourth external heating roller 304 is greater than or equal to the stiffness of the fixing roller 101, and the sum of the stiffness of the pressure roller 102 and the stiffnesses of the third external heating roller 303 and the fourth external heating roller 304 is greater than or equal to twice the stiffness of the fixing roller 101.

By virtue of the features described hereinabove, even if the process speed is increased even further, the fixing apparatus 300 is excellent in terms of fixing roller's temperature follow-up capability, fixability, paper conveyance capability, and energy conservation.

[Image Forming Apparatus]

Figure 6:
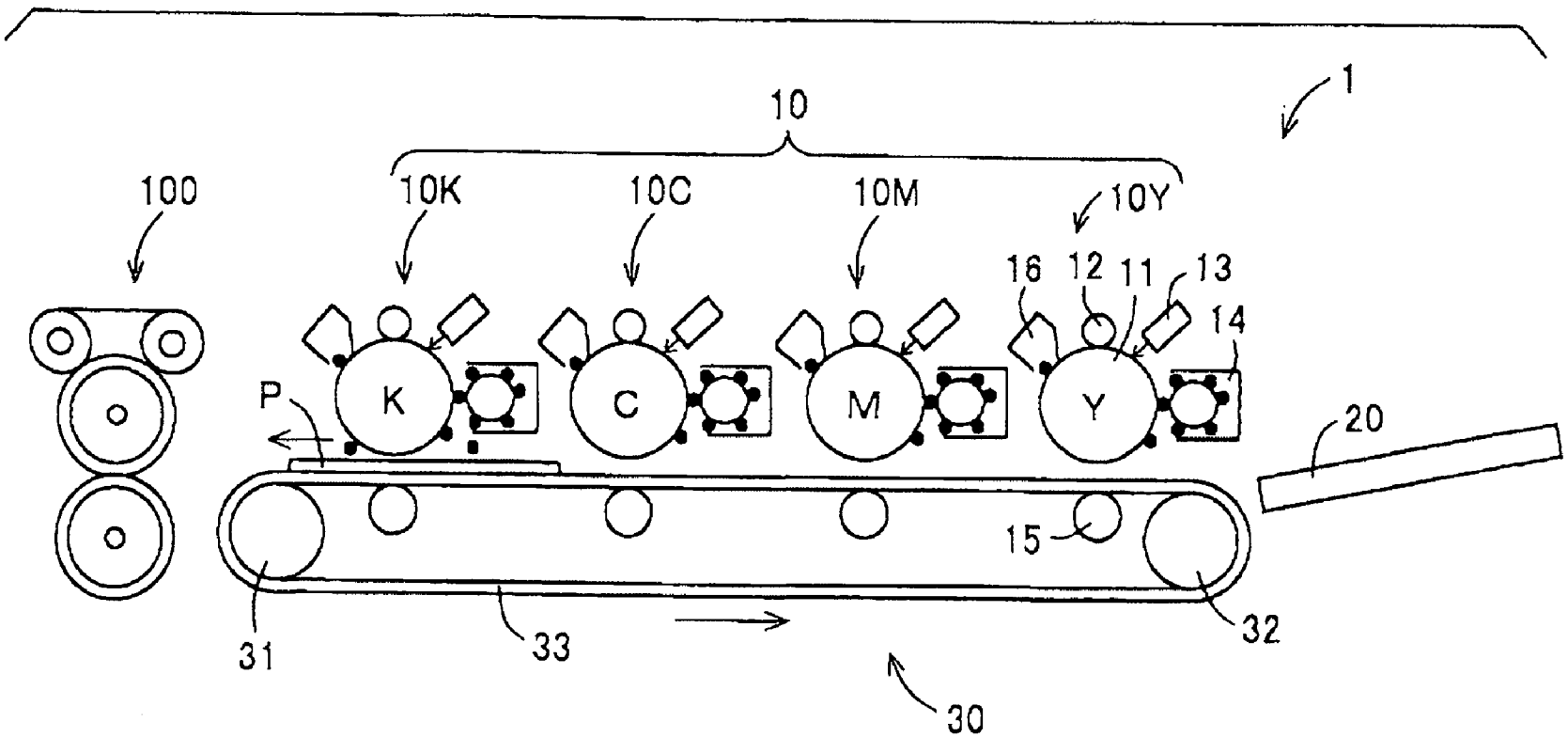
FIG. 6 is a schematic view showing an example of the structure of an image forming apparatus having the fixing apparatus of the invention.

FIG. 6 is a schematic view showing an example of the structure of an image forming apparatus 1 having the fixing apparatus 100 of the invention. While, in the following description, the fixing apparatus 100 implemented by way of the first embodiment of the invention will be taken up as a representative example of the fixing apparatus incorporated in the image forming apparatus 1, the fixing apparatus 200 of the second embodiment and the fixing apparatus 300 of the third embodiment as well can be employed in place of the fixing apparatus 100.

The image forming apparatus 1 is built for example as a so-called xerographic color image forming apparatus. In the image forming apparatus 1, for example, on the basis of image data transmitted from each terminal unit on the network, a multicolored image or monochromatic image is formed on a predetermined recording sheet P.

The image forming apparatus 1 comprises the fixing apparatus 100, four pieces of visible image forming units 10Y, 10M, 10C, and 10B (hereafter also referred to collectively as "visible image forming unit 10"), a feeding tray 20, and a recording sheet conveying section 30.

In order to deal with various colors: yellow (Y); magenta (M); cyan (C); and black (K), the four visible image forming units 10Y, 10M, 10C, and 10B are arranged side by side in the image forming apparatus 1. The visible image forming unit 10Y effects image formation with use of a yellow (Y)-color toner, the visible image forming unit 10M effects image formation with use of a magenta (M)-color toner, the visible image forming unit 10C effects image formation with use of a cyan (C)-color toner, and the visible image forming unit 10B effects image formation with use of a black (K)-color toner. More specifically, the four visible image forming units 10 are arranged along a recording-sheet P conveyance path formed so as to provide connection between the recording-sheet P feeding tray 20 and the fixing apparatus 100. That is, the image forming apparatus 1 is of a so-called tandem type.

The visible image forming units 10 have substantially the same configuration, the sole difference being the color of toner for use. Each of the visible image forming units 10 is constructed by disposing, around a photoreceptor drum 11, a charging roller 12, a laser scanning section 13, a developing device 14, a transfer roller 15, and a cleaner unit 16. Note that the developing devices 14 of the visible image forming units 10Y, 10M, 10C, and 10B hold a yellow (Y)-color toner, a magenta (M)-color toner, a cyan (C)-color toner, and a black (K)-color toner, respectively.

On the photoreceptor drum 11 is borne a toner image formed. The charging roller 12 effects charging on the surface of the photoreceptor drum 11 evenly at a predetermined potential. The laser scanning section 13 exposes the surface of the photoreceptor drum 11 charged by the charging roller 12 to light on the basis of image data inputted to the image forming apparatus 1, whereupon an electrostatic latent image is formed on the surface of the photoreceptor drum 11, The developing device 14 turns the electrostatic latent image formed on the surface of the photoreceptor drum 11 into a visible image by means of the toner of each color. The transfer roller 15 receives application of a bias voltage of a polarity reverse to the polarity of the charge on the toner thereby to transfer the formed toner image onto the recording sheet P conveyed by the recording sheet conveying section 30 which will be described later on. The cleaner unit 16 removes and collects residual toner portions which remain on the photoreceptor drum 11 following the development process conducted by the developing device 14 and the process to transfer the toner image formed on the photoreceptor drum 11. In the presence of the four different colors, the above-described toner image transference onto the recording sheet P is conducted separately fox individual colors; that is, repeated four times.

The visible image forming unit 10 performs toner image formation on the recording sheet P in the following manner. After the surface of the photoreceptor drum 11 is charged evenly by the charging roller 12, on the basis of the input image data, the surface of the photoreceptor drum 11 is exposed to light by the laser scanning section 13, whereupon an electrostatic latent image is formed thereon. After that, the electrostatic latent image formed on the surface of the photoreceptor drum 11 is developed by the developing device 14 to effect toner-image visualization. Then, by the transfer roller 15 to which is impressed a bias voltage of a polarity reverse to the polarity of the charge on the toner, the visualized toner images of different colors are transferred and overlaid one after another onto the recording sheet P conveyed from the feeding tray 20 to the recording sheet conveying section 30.

It is possible to place a plurality of recording sheets P in the feeding tray 20. The plurality of recording sheets P placed in the feeding tray 20 are separately fed to the visible image forming unit 10Y arranged nearest to the feeding tray 20, one by one.

The recording sheet conveying section 30 comprises a driving roller 31, an idling roller 32, and a conveyance belt 33. The recording sheet P fed from the feeding tray 20 is conveyed by the recording sheet conveying section 30 in such a manner that the toner image formed by the visible image forming unit 10 can be transferred onto the recording sheet P properly. The driving roller 31 and the idling roller 32 allows the conveyance belt 33 designed in an endless-belt form to be suspended in a tensioned state. The driving roller 31 is rotated under the control of a driving section (not shown), so that the conveyance belt 33 can be turned along the conveyance path at a predetermined circumferential velocity, for example, 220 mm/s. The conveyance belt 33 undergoes static electricity generation at its outer surface, wherefore the recording sheet P is conveyed while being electrostatically attracted to the conveyance belt 33.

In this way, the recording sheet P is conveyed along the conveyance path by the conveyance belt 33, during which period the toner image is transferred onto the surface of the recording sheet P. After that, the recording sheet P is separated from the conveyance belt 33 due to the curvature of the driving roller 31, and is then conveyed to the fixing apparatus 100. In the fixing apparatus 100, adequate heat and pressure are applied to the recording sheet P, whereupon the toner is melted and fixed onto the surface of the recording sheet P. As a result, a full-color image can be formed.

With the provision of the fixing apparatus 100 of the invention, even if the process speed is increased, the image forming apparatus 1 of the invention is excellent in terms of fixing roller's temperature follow-up capability, fixability, paper conveyance capability, and energy conservation.

EXAMPLES

Hereinafter, the invention will be described concretely with Examples and Comparative examples. It should be noted that the invention is not limited to the examples set forth hereunder insofar as there is no departure from the spirit and scope of the invention.

The Young's moduli (σ) of carbon steel (STKM), stainless steel (SUS), and aluminum are 21000 (Kg/mm$^2$), 21000 (Kg/mm$^2$), and 7200 (Kg/mm$^2$), respectively.

Example 1

A fixing apparatus of Example 1 is identical in construction with the fixing apparatus 100 shown in FIG. 1. Hereinafter, the specifications of components constituting the fixing apparatus of Example 1 will be explained.

A member for use as the fixing roller 101 (22 mm in outer diameter) was constructed by forming, over the outer peripheral surface of a metal core of solid-shaft type made of carbon steel (STKM) having an outer diameter of 16 mm and a thickness of 0.8 mm, a 3 mm-thick silicone rubber-made elastic layer and a 30 μm-thick PFA-made release layer successively in the order named.

A member for use as the pressure roller 102 (22 mm in outer diameter) was constructed by forming, over the outer peripheral surface of a metal core made of stainless steel (SUS) having an outer diameter of 16 mm and a thickness of 8 mm, a 3 mm-thick silicone rubber-made elastic layer and a 30 μm-thick PFA-made release layer successively in the order named.

A member for use as the external heating belt 103 was constructed by forming a 20 μm-thick PTFE-made release layer on a surface of an endless-type polyimide belt having an outer diameter of 34 mm and a thickness of 90 μm.

A member for use as the first external heating roller 104 and the second external heating roller 105 as well was composed of a hollow cylindrical, carbon steel (STKM)-made core member having an outer diameter of 15 mm and a thickness of 0.75 mm. The first external heating roller 104 and the second external heating roller 105 were so arranged that the center-to-center distance between them was 27 mm and the mounting angles θ1 and θ2 were each 45°.

A member for use as the first heater lamp 106 and the second heater lamp 107 as well was rated at 600 W of power, and a member for use as the third heater lamp 108 was rated at 400 W of power. Each of the fixing roller 101, the pressure roller 102, the first external heating roller 104, and the second external heating roller 105 has a length of 220 mm in the direction longitudinally thereof. The external heating belt 103 is 220 mm in belt width.

The fixing load in the fixing nip region N1 and the pressing load in the heating nip region N2 were each set at 176N. The fixing nip width of the fixing nip region N1 and the heating nip width of the heating nip region N2 were set at 8 mm and 20 mm, respectively.

In Table 1 are listed the specifications, Young's moduli (σ), geometrical moments of inertia (M), stiffnesses (σ×M), and summed stiffness as to the fixing roller 101, the pressure roller 102, the first external heating roller 104, and the second external heating roller 105 in the fixing apparatus of Example 1.

TABLE 1

| | | Fixing roller | Pressure roller | First external heating roller | Second external heating roller |
|---|---|---|---|---|---|
| Outer diameter (mm) | | 22 | 22 | 15 | 15 |
| Metal core (core member) | Outer diameter (mm) | 16 | 16 | 15 | 15 |
| | Thickness (mm) | 0.8 | 8 | 0.75 | 0.75 |
| | Material | STKM | SUS | STKM | STKM |
| θ1 or θ2 (°) | | — | — | 45 | 45 |
| σ (Kg/mm$^2$) | | 21000 | 21000 | 21000 | 21000 |
| M (mm$^4$) | | 1106 | 3217 | 855 | 855 |
| Stiffness (σ × M) | | $2.32 \times 10^7$ | $6.76 \times 10^7$ | $1.27 \times 10^7$ | $1.27 \times 10^7$ |
| Summed stiffness | | $2.32 \times 10^7$ | $6.76 \times 10^7$ | $2.54 \times 10^7$ | |

Example 2

A fixing apparatus of Example 2 is identical in construction with the fixing apparatus 200 shown in FIG. 4. Hereinafter, the specifications of components constituting the fixing apparatus of Example 2 will be explained.

A member for use as the first external heating roller 201 was composed of a hollow cylindrical, carbon steel (STKM)-made core member having an outer diameter of 22 mm at its opposite ends and a thickness of 0.3 mm. The first external heating roller 201 was designed to have a crown shape in which, when viewed in the direction longitudinally thereof, the outer diameter at its midportion was, for example, approximately 0.1 mm larger than the outer diameter at its opposite ends. A member for use as the second external heating roller 202 was composed of a hollow cylindrical, aluminum-made core member having an outer diameter of 8 mm and a thickness of 6 mm. The first external heating roller 201 and the second external heating roller 202 were so arranged that the center-to-center distance between them is 26 mm and the mounting angle θ1 and the mounting angle θ2 were 0° and 90°, respectively.

A member for use as the first heater lamp 106 was rated at 1200 W of power.

Each of the first external heating roller 201 and the second external heating roller 202 has a length of 220 mm in the direction longitudinally thereof.

Apart from the above-described points, the fixing apparatus 200 is similar in construction to the fixing apparatus 100 of Example 1.

In Table 2 are listed the specifications, Young's moduli (σ), geometrical moments of inertia (M), stiffnesses (σ×M), and summed stiffness as to the fixing roller 101, the pressure roller 102, the first external heating roller 201, and the second external heating roller 202 in the fixing apparatus of Example 2.

TABLE 2

| | | Fixing roller | Pressure roller | First external heating roller | Second external heating roller |
|---|---|---|---|---|---|
| Outer diameter (mm) | | 22 | 22 | 22 | 8 |
| Metal core (core member) | Outer diameter (mm) | 16 | 16 | 22 | 8 |
| | Thickness (mm) | 0.8 | 8 | 0.3 | 6 |
| | Material | STKM | SUS | STKM | Aluminum |
| θ1 or θ2 (°) | | — | — | 0 | 90 |
| σ (Kg/mm$^2$) | | 21000 | 21000 | 21000 | 7200 |
| M (mm$^4$) | | 1106 | 3217 | 1106 | 46 |
| Stiffness (σ × M) | | $2.32 \times 10^7$ | $6.76 \times 10^7$ | $2.53 \times 10^7$ | 0 |
| Summed stiffness | | $2.32 \times 10^7$ | $6.76 \times 10^7$ | $2.53 \times 10^7$ | |

Example 3

A fixing apparatus of Example 3 is identical in construction with the fixing apparatus 300 shown in FIG. 5. Hereinafter, the specifications of components constituting the fixing apparatus of Example 3 will be explained.

A member for use as the pressure roller 102 (22 mm in outer diameter), which was identical in construction with the fixing roller 101, was constructed by forming, over the outer peripheral surface of a metal core made of carbon steel (STKM) having an outer diameter of 16 mm and a thickness of 0.8 mm, a 3 mm-thick silicone rubber-made elastic layer and a 30 μm-thick PFA-made release layer successively in the order named.

A member for use as the external heating belt 302, which was identical in construction with the external heating belt 103, was constructed by forming a 20 μm-thick PTFE-made release layer on a surface of an endless-type polyimide belt having an outer diameter of 34 mm and a thickness of 90 μm.

A member for use as the third external heating roller 303, which was identical in construction with the first external heating roller 201, was composed of a hollow cylindrical, carbon steel (STKM)-made core member having an outer diameter of 22 mm at its opposite ends and a thickness of 0.3 mm. The third external heating roller 303 was designed to have a crown shape in which, when viewed in the direction longitudinally thereof, the outer diameter at its midportion was, for example, approximately 0.1 mm larger than the outer diameter at its opposite ends. A member for use as the fourth external heating roller 304, which was identical in construction with the second external heating roller 202, was composed of a hollow cylindrical, aluminum-made core member having an outer diameter of 8 mm and a thickness of 6 mm. The third external heating roller 303 and the fourth external heating roller 304 were so arranged that the center-to-center distance between them was 26 mm and the mounting angle θ1 and the mounting angle θ2 were 0° and 90°, respectively.

A member for use as the fourth heater lamp 301 and the fifth heater lamp 305 as well was rated at 400 W of power.

Each of the third external heating roller 303 and the fourth external heating roller 304 has a length of 220 mm in the direction longitudinally thereof.

Apart from the above-described points, the fixing apparatus 300 is similar in construction to the fixing apparatus 200 of Example 2.

The pressing load in the heating nip region N3 was set at 176 N. The heating nip width of the heating nip region N3 was set at 20 mm.

In Table 3 are listed the specifications, Young's moduli (σ), geometrical moments of inertia (M), stiffnesses (σ×M), and summed stiffness as to the fixing roller 101, the pressure roller 102, the first external heating roller 201, the second external heating roller 202, the third external heating roller 303, and the fourth external heating roller 304 in the fixing apparatus of Example 3.

TABLE 3

| | | Fixing roller | Pressure roller | First and third external heating rollers | Second and fourth external heating rollers |
|---|---|---|---|---|---|
| Outer diameter (mm) | | 22 | 22 | 22 | 8 |
| Metal core (core member) | Outer diameter (mm) | 16 | 16 | 22 | 8 |
| | Thickness (mm) | 0.8 | 0.8 | 0.3 | 6 |
| | Material | STKM | STKM | STKM | Aluminum |
| θ1 or θ2 (°) | | — | — | 0 | 90 |
| σ (Kg/mm$^2$) | | 21000 | 21000 | 21000 | 7200 |
| M (mm$^4$) | | 1106 | 1106 | 1106 | 46 |
| Stiffness (σ × M) | | $2.32 \times 10^7$ | $2.32 \times 10^7$ | $2.53 \times 10^7$ | 0 |
| Summed stiffness | | $2.32 \times 10^7$ | $2.32 \times 10^7$ | $2.53 \times 10^7$ | |

Comparative Example 1

Figure 7:
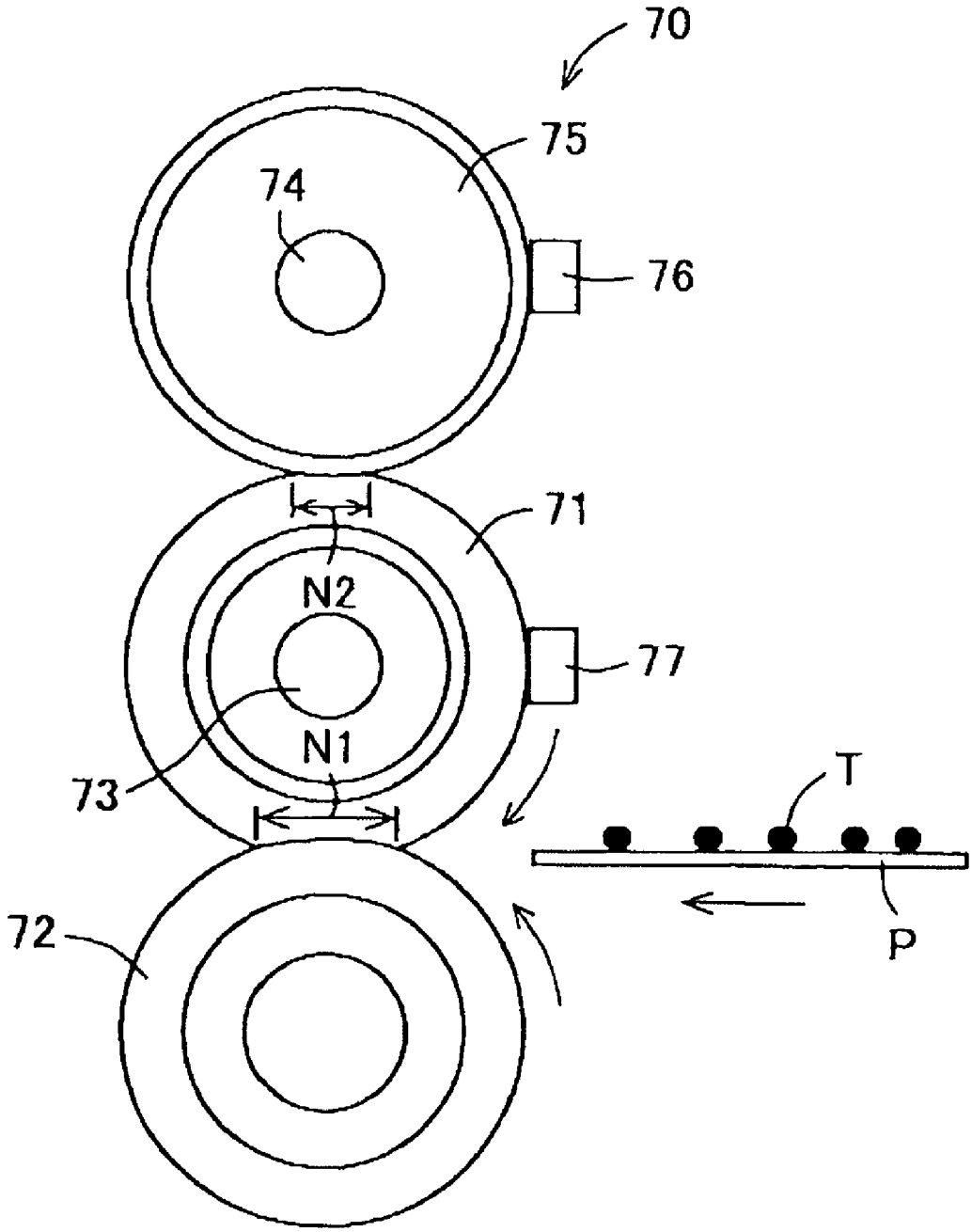
FIG. 7 PRIOR ART
FIG. 7 is a front view showing an example of the structure of a conventional heat-roller fixing type fixing apparatus in simplified form.

A fixing apparatus of Comparative example 1 is identical in construction with the fixing apparatus 70 shown in FIG. 7. Hereinafter, the specifications of components constituting the fixing apparatus of Comparative example 1 will be explained.

A member for use as the fixing roller 71 was identical with the fixing roller 101 in Example 1. A member for use as the pressure roller 72 was identical with the pressure roller 102 in Example 1.

A member for use as the external heating roller 75 was composed of a hollow cylindrical, carbon steel (STKM)-made core member having an outer diameter of 22 mm and a thickness of 0.3 mm. The external heating roller 75 was disposed in such a manner that, out of two angles that a direction in which a straight line segment connecting the center of the external heating roller 75 and the center of the fixing roller 71 extended formed with the angular reference direction, the smaller one, namely the mounting angle θ1, was 0°. That is, the external heating roller 75 was located immediately above the fixing roller 71.

A member for use as the heater lamp 73 was rated at 400 w of power, and a member for use as the heater lamp 74 was rated at 1200 W of power.

Each of the fixing roller 71, the pressure roller 72, and the external heating roller 75 has a length of 220 mm in the direction longitudinally thereof.

The fixing load in the fixing nip region N1 and the pressing load in the heating nip region N2 were each set at 176 N. The fixing nip width of the fixing nip region N1 and the heating nip width of the heating nip region N2 were set at 8 mm and 3 mm, respectively.

In Table 4 are listed the specifications, Young's moduli (σ), geometrical moments of inertia (M), stiffnesses (σ×M), and summed stiffness as to the fixing roller 71, the pressure roller 72, and the heating roller 75 in the fixing apparatus of Comparative example 1.

TABLE 4

| | | Fixing roller | Pressure roller | External healing roller |
|---|---|---|---|---|
| Outer diameter (mm) | | 22 | 22 | 22 |
| Metal core (core member) | Outer diameter (mm) | 16 | 16 | 22 |
| | Thickness (mm) | 0.8 | 0.8 | 0.3 |
| | Material | STKM | SUS | STKM |
| θ1 or θ2 (°) | | — | — | 0 |
| σ (Kg/mm$^2$) | | 21000 | 21000 | 21000 |
| M (mm$^4$) | | 1106 | 3217 | 1106 |
| Stiffness (σ × M) | | $2.32 \times 10^7$ | $6.76 \times 10^7$ | $2.53 \times 10^7$ |
| Summed stiffness | | $2.32 \times 10^7$ | $6.78 \times 10^7$ | $2.53 \times 10^7$ |

Comparative Example 2

A fixing apparatus of Comparative example 2 is identical in construction with the fixing apparatus 100 shown in FIG. 1. Hereinafter, the specifications of components constituting the fixing apparatus of Comparative example 2 will be explained.

A member for use as the first external heating roller 104 and the second external heating roller 105 as well is composed of a hollow cylindrical, aluminum-made core member having an outer diameter of 15 mm and a thickness of 1.2 mm. Otherwise, the fixing apparatus of Comparative example 2 is similar in construction to the fixing apparatus of Example 1.

In Table 5 are listed the specifications, Young's moduli (σ), geometrical moments of inertia (M), stiffnesses (σ×M), and summed stiffness as to the fixing roller 101, the pressure roller 102, the first external heating roller 104, and the second external heating roller 105 in the fixing apparatus of Comparative example 2.

Note that the fixing apparatus of Comparative example 2 differs from the fixing apparatus of Example 1 in that the value of the sum of stiffnesses of the external heating members is smaller than the stiffness value of the fixing roller.

TABLE 5

| | | Fixing roller | Pressure roller | First external heating roller | Second external heating roller |
|---|---|---|---|---|---|
| Outer diameter (mm) | | 22 | 22 | 15 | 15 |
| Metal core (core member) | Outer diameter (mm) | 16 | 16 | 15 | 15 |
| | Thickness (mm) | 0.8 | 0.8 | 1.2 | 1.2 |
| | Material | STKM | SUS | Aluminum | Aluminum |
| θ1 or θ2 (°) | | — | — | 45 | 45 |
| σ (Kg/mm$^2$) | | 21000 | 21000 | 7200 | 7200 |
| M (mm$^4$) | | 1106 | 3217 | 855 | 855 |
| Stiffness (σ × M) | | $2.32 \times 10^7$ | $6.76 \times 10^7$ | $0.635 \times 10^7$ | $0.635 \times 10^7$ |
| Summed stiffness | | $2.32 \times 10^7$ | $6.76 \times 10^7$ | $1.27 \times 10^7$ | |

Comparative Example 3

A fixing apparatus of Comparative example 3 is identical in construction with the fixing apparatus 100 shown in FIG. 1. Hereinafter, the specifications of components constituting the fixing apparatus of Comparative example 3 will be explained.

A member for use as the pressure roller 102 (22 mm in outer diameter), which is identical in construction with the fixing roller 101, is constructed by forming, over the outer peripheral surface of a solid-shaft type metal core made of carbon steel (STKM) having an outer diameter of 16 mm and a thickness of 0.8 mm, a 3 mm-thick silicone rubber-made elastic layer and a 30 μm-thick PFA-made release layer successively in the order named. Otherwise, the fixing apparatus of Comparative example 3 is similar in construction to the fixing apparatus of Example 1.

In Table 6 are listed the specifications, Young's moduli (σ), geometrical moments of inertia (i), stiffnesses (σ×M), and summed stiffness as to the fixing roller 101, the pressure roller 102, the first external heating roller 104, and the second external heating roller 105 in the fixing apparatus of Comparative example 3.

Note that the fixing apparatus of Comparative example 3 differs from the fixing apparatus of Example 1 in that the stiffness value of the fixing roller is equal to the stiffness value of the pressure roller.

TABLE 6

| | | Fixing roller | Pressure roller | First external heating roller | Second external heating roller |
|---|---|---|---|---|---|
| Outer diameter (mm) | | 22 | 22 | 15 | 15 |
| Metal core (core member) | Outer diameter (mm) | 16 | 16 | 15 | 15 |
| | Thickness (mm) | 0.8 | 0.8 | 0.75 | 0.75 |
| | Material | STKM | STKM | STKM | STKM |
| θ1 or θ2 (°) | | — | — | 45 | 45 |
| σ (Kg/mm$^2$) | | 21000 | 21000 | 21000 | 21000 |
| M (mm$^4$) | | 1106 | 1106 | 855 | 855 |
| Stiffness (σ × M) | | $2.32 \times 10^7$ | $2.32 \times 10^7$ | $1.27 \times 10^7$ | $1.27 \times 10^7$ |
| Summed stiffness | | $2.32 \times 10^7$ | $2.32 \times 10^7$ | $2.54 \times 10^7$ | |

Experimental Example 1

Evaluations have been made as to the image forming apparatuses incorporating the fixing apparatuses of Example 1 and Comparative examples 1 to 3, respectively, in terms of warm-up period of time, temperature follow-up capability, fixability, and paper conveyance capability, in accordance with the following methods. The results of evaluations and the results of comprehensive evaluation are listed in Table 8.

[Warm-Up Period of Time]

At power-on for warming-up, the heat source of the first external heating member or the external heating roller was used prior to the use of the heat source disposed inside the fixing roller within a range of 1200 W at a maximum. In this state, warming-up was effected with the fixing roller kept rotated from the outset, and the time for the fixing roller to reach 190° C. was measured.

Temperature control was exercised in such a manner that the temperature of the inner peripheral surface of the external heating belt stood at 220° C. and the temperature of the fixing roller stood at 190° C. The fixing roller is set to rotate at a speed of 220 mm/sec.

[Temperature Follow-Up Capability]

After the rotation of the fixing roller was brought to a halt and the temperature of the inner peripheral surface of the external heating belt and the temperature of the fixing roller were so controlled as to reach 220° C. and 190° C., respectively, the apparatus was left standing for 10 minutes to stand ready for operation. Then, with the fixing roller kept rotated at a fixing speed of 173 mm/sec, a total of 100 pieces of A4-size paper (basis weight; 80 g/m$^2$) were fed successively in the direction longitudinally thereof at a copying speed of 30 copies/min. Under such conditions, an evaluation of the temperature follow-up capability of the fixing roller was conducted. The criteria for evaluation are listed below. Note that, in Table 8, the term in parentheses indicates a decrease in temperature with respect to 190° C. (hereafter referred to as "undershooting temperature").

Good: temperature level of 190° C. could be maintained.

Poor: temperature level of 190° C. could not be maintained.

[Fixability]

Under the same conditions as those adopted in the temperature follow-up capability evaluation, a single piece of paper was fed in total to fix thereon a solid image composed of three color layers (adherent toner amount: 1.5 mg/cm$^2$), and a fixability evaluation was conducted in accordance with a folding test. In the folding test, the paper having fixed thereon the solid image is folded in a direction perpendicular to the paper feeding direction, with the result that the paper undergoes peeling of toner image at its fold. Then, a comparison is made between the width of the peeled-off toner image in the fold and the width of the corresponding part of a limit sample. The smaller is the width of the peeled-off toner image, the higher is the fixability. The limit sample for use was obtained by folding similarly a paper sheet having six images fixed thereon at different fixing strengths. The criteria for evaluation are listed below. Note that, in Table 8, the term in parentheses indicates, when viewed in the direction of the width of the paper, which part is judged to exhibit poor fixability.

Good: judged as being satisfactory as the result of comparison with limit sample.

Poor: judged as being unsatisfactory as the result of comparison with limit sample.

[Paper Conveyance Capability]

Under the same conditions as those adopted in the temperature follow-up capability evaluation except for the type of paper for use: A4-size paper having a basis weight of 64 g/m$^2$, three pieces of paper were fed in total, and a paper-conveyance capability evaluation was conducted by visual observation. The criteria for evaluation are as follows:

Good: paper was free from wrinkles.

Poor: paper got wrinkles.

[Comprehensive Evaluation]

Comprehensive evaluation is performed according to the following criteria:

Good: rated as being satisfactory, with no failing grade in every evaluative point.

Poor: rated as being unsatisfactory, with failing grade at least in one of evaluative points.

Table 7 given below shows the form of means for heating the fixing roller externally (hereafter referred to as "external heating method"), the ratio of the sum of the stiffnesses of the plurality of first external heating members to the stiffness of the fixing roller, the ratio of the stiffness of the pressure roller to the stiffness of the fixing roller, the heating nip width, the fixing nip width, and the total heat capacity of the first external heating members or the external heating rollers.

TABLE 7

| | External heating method | Sum of stiffnesses of first external heating members or external heating rollers | Stiffness of the pressure roller/stiffness of fixing roller | Heating nip width (mm) | Fixing nip width (mm) Opposite ends | Fixing nip width (mm) Midportion | Total heat capacity of first external heating members or external heating rollers (J/° C.) |
|---|---|---|---|---|---|---|---|
| Example. 1 | Belt | 1.09 | 2.91 | 20 | 8 | 8 | 59.6 |
| Comparative example 1 | Roller | 1.09 | 2.91 | 3 | 8 | 8 | 17 |
| Comparative example 2 | Belt | 0.55 | 2.91 | 20 | 8 | 6 | 60.6 |
| Comparative example 3 | Belt | 1.09 | 1 | 20 | 8 | 6 | 59.6 |

TABLE 8

| | Warm-up period of time (sec) | Temperature follow-up capability | Fixability | Paper conveyance capability | Comprehensive evaluation |
|---|---|---|---|---|---|
| Example 1 | 29.6 | Good (0° C.) | Good | Good | Good |
| Comparative example 1 | 51.0 | Poor (−30° C.) | Good | Good | Poor |
| Comparative example 2 | 30.4 | Good (0° C.) | Poor (midportion) | Poor | Poor |
| Comparative example 3 | 29.2 | Good (0° C.) | Poor (midportion) | Poor | Poor |

As shown in Tables 7 and 8, according to the fixing apparatus of Example 1, the external heating belt was used as the means for heating the fixing roller externally. This made it possible to obtain a heating nip region as large as 20 mm, and thereby produce excellent results in warm-up period of time and in temperature follow-up capability. Moreover, the external heating member-to-fixing roller stiffness ratio is 1.09; that is, the sum of the stiffnesses of the plurality of first external heating members is larger than the stiffness of the fixing roller. Further, the pressure roller-to-fixing roller stiffness ratio is 2.91; that is, the stiffness of the pressure roller is greater than twice the stiffness of the fixing roller.

Accordingly, it was possible to obtain an adequate effect of suppressing the deflection of the fixing roller and thereby produce excellent results in fixability and in paper conveyance capability as well.

On the other hand, according to the fixing apparatus of Comparative example 1, the external heating roller was used in place of the external heating belt as the means for heating the fixing roller externally. In this case, the obtained heating nip width was as small as 3 mm, in consequence whereof there resulted poor efficiency in heating of the fixing roller. This led to deterioration in terms of warm-up period of time and in temperature follow-up capability.

Furthermore, according to the fixing apparatus of Comparative example 2, the external heating member-to-fixing roller stiffness ratio is 0.55; that is, the sum of the stiffnesses of the external heating members is smaller than the stiffness of the fixing roller. This made it impossible to obtain an adequate effect of suppressing the deflection of the fixing roller. As a result, when viewed in the direction longitudinally of the fixing roller, the fixing nip width at its midportion (6 mm) was smaller than the fixing nip width at its opposite ends (8 mm). This led to poor fixability at the midportion of the paper in its widthwise direction. In addition, the paper was conveyed, with a difference in paper conveyance speed caused between its widthwise midportion and its widthwise opposite ends. This led to poor paper conveyance capability.

Furthermore, according to the fixing apparatus of Comparative example 3, the pressure roller-to-fixing roller stiffness ratio is 1.00; that is, the stiffness of the pressure roller is equal to the stiffness of the fixing roller. This made it impossible to obtain an adequate effect of suppressing the deflection of the pressure roller. As a result, when viewed in the direction longitudinally of the pressure roller, the fixing nip width at its midportion (6 mm) was smaller than the fixing nip width at its opposite ends (8 mm). This led to poor fixability at the midportion of the paper in its widthwise direction. In addition, the paper was conveyed, with a difference in paper conveyance speed caused between its widthwise midportion and its widthwise opposite ends. This led to poor paper conveyance capability.

Experimental Example 2

Evaluations have been made as to the image forming apparatuses incorporating the fixing apparatuses of Examples 1 through 3, respectively, in terms of warm-up period of time, temperature follow-up capability, fixability, paper conveyance capability, and temperature uniformity in accordance with the following methods, The results of evaluations and the results of comprehensive evaluation are listed in Table 10. Note that the method for evaluating paper conveyance capability is the same as that adopted in Experimental example 1, and thus the description thereof will be omitted.

[Warm-Up Period of Time]

At power-on for warming-up, the heat source of the first external heating member was used prior to the use of the heat source disposed inside the fixing roller within a range of 1200 W at a maximum. In addition, in Example 3, the heat source of the second external heating member was used prior to the use of the heat source disposed inside the pressure roller. In this state, warming-up was effected with the fixing roller kept rotated from the outset, and the time for the fixing roller to reach 190° C. was measured.

Temperature control was exercised in such a manner that the temperature of the inner peripheral surface of the external heating belt stood at 220° C. and the temperature of the fixing roller stood at 190° C. The fixing roller was set to rotate at a speed of 220 mm/sec.

[Temperature Follow-Up Capability]

(Condition 1)

After the rotation of the fixing roller was brought to a halt and the temperature of the inner peripheral surface of the external heating belt and the temperature of the fixing roller were so controlled as to reach 220° C. and 190° C., respectively, and in addition, in Example 3, the temperature of the pressure roller was so controlled as to reach 100° C., the apparatus was left standing for 10 minutes to, stand ready for operation. Then, with the fixing roller kept rotated at a fixing speed of 173 mm/sec, a total of 100 pieces of A4-size paper (basis weight: 80 g/m$^2$) were fed successively in the direction longitudinally thereof at a copying speed of 30 copies/min. In this state, the temperature follow-up capabilities of the fixing roller and the pressure roller were evaluated. The evaluation of temperature follow-up capability was made on the basis of whether or not the temperature of the fixing roller could be maintained at 190° C. and whether or not the temperature of the pressure roller could be maintained at 100° C. The criteria for evaluation are as follows:

Good: both the fixing roller and the pressure roller could be maintained at their respective predetermined temperatures.

Poor: at least one of the fixing roller and the pressure roller failed to keep the predetermined temperature.

(Condition 2)

After the rotation of the fixing roller was brought to a halt and the temperature of the inner peripheral surface of the external heating belt and the temperature of the fixing roller were so controlled as to reach 220° C. and 190° C., respectively, and in addition, in Example 3, the temperature of the pressure roller was so controlled as to reach 140° C., the apparatus was left standing for 10 minutes to stand ready for operation. Then, with the fixing roller kept rotated at a fixing speed of 220 mm/sec, a total of 100 pieces of A4-size paper (basis weight: 80 g/m$^2$) were fed successively in the direction longitudinally thereof at a copying speed of 40 copies/min. In this state, the temperature follow-up capability of the fixing roller was evaluated. The evaluation of temperature follow-up capability was made on the basis of whether or not the temperature of the fixing roller could be maintained at 190° C. and whether or not the temperature of the pressure roller could be maintained at 140° C. The criteria for evaluation are as follows:

Good: both the fixing roller and the pressure roller could be maintained at their respective predetermined temperatures.

Poor: at least one of the fixing roller and the pressure roller failed to keep the predetermined temperature.

[Fixability]

Under the same conditions as those adopted in the temperature follow-up capability evaluation, namely Conditions 1 and 2, a single piece of paper was fed in total to fix thereon a solid image composed of three color layers (adherent toner amount: 1.5 mg/cm$^2$), and a fixability evaluation was conducted in accordance with a folding test, just as was the case with Experimental example 1.

Good: judged as being satisfactory as the result of comparison.

Poor: judged as being unsatisfactory as the result of comparison.

[Temperature Uniformity]

Under the same condition as Condition 1 adopted in the temperature follow-up capability evaluation except for the type of paper for use: B5-size paper having a basis weight of 80 g/m$^2$, paper feeding was effected to evaluate the temperature uniformity of the fixing roller. The evaluation of temperature uniformity was made on the basis of a measured value obtained by monitoring the temperature distribution in the fixing roller in the direction longitudinally thereof by means of a noncontact-type radiation thermometer (thermotracer). The criteria for evaluation are as follows:

Excellent: difference in temperature between paper-passing region and non-paper-passing region is smaller than or equal to 5° C.

Good: difference in temperature between paper-passing region and non-paper-passing region is larger than 5° C. but smaller than or equal to 15° c.

Unfavorable: difference in temperature between paper-passing region and non-paper-passing region is larger than 15° C. but smaller than or equal to 25° C.

Poor: difference in temperature between paper-passing region and non-paper-passing region is larger than 25° C.

[Comprehensive Evaluation]

Comprehensive evaluation is performed according to the following criteria:

Excellent: rated as being fairly good (no failing grade in every evaluative point).

Good: rated as being satisfactory (failing grade: 2 or less, grade "unfavorable": 0 in evaluative points).

Acceptable: rated as being practicable (failing grade: 2 or less, grade "unfavorable": 1 or 0).

Poor: rated as being defective (failing grade: 3 or more in evaluative points).

Table 9 given below shows the external heating method, the ratio of the sum of the stiffnesses of the plurality of first external heating members to the stiffness of the fixing roller, the ratio of the sum of the stiffnesses of plurality of the second external heating members and the stiffness of the pressure roller to the stiffness of the fixing roller, the heating nip width, the fixing nip width, and the total heat capacity of the first external heating members and that of the second external heating members.

TABLE 9

| | External heating method | Sum of stiffnesses of first external heating members/stiffness of fixing roller | Sum of stiffnesses of pressure roller and second external heating members/stiffness of fixing roller | Heating nip width (mm) | Fixing nip width (mm) | | Total heat capacity of first external heating members (J/° C.) | Total heat capacity of second external heating members (J/° C.) |
|---|---|---|---|---|---|---|---|---|
| | | | | | Opposite ends | Midportion | | |
| Example 1 | Belt | 1.09 | 2.91 | 20 | 8 | 8 | 59.6 | 0 |
| Example 2 | Belt | 1.09 | 2.91 | 20 | 8 | 8 | 32.8 | 0 |
| Example 3 | Belt | 1.09 | 2.91 | 20 | 8 | 8 | 32.8 | 32.8 |

TABLE 10

| | Warm-up period of time (sec) | Temperature follow-up capability | | Fixability | | Paper conveyance capability | Temperature uniformity | Comprehensive evaluation |
|---|---|---|---|---|---|---|---|---|
| | | Condition 1 | Condition 2 | Condition 1 | Condition 2 | | | |
| Example 1 | 29.6 | Good | Poor | Good | Poor | Good | Unfavorable | Acceptable |
| Example 2 | 24.4 | Good | Poor | Good | Poor | Good | Good | Good |
| Example 3 | 28.2 | Good | Good | Good | Good | Good | Excellent | Excellent |

As shown in Tables 9 and 10, according to the fixing apparatus of Example 1, the external heating belt was used as the means for heating the fixing roller externally. This made it possible to obtain a heating nip region as large as 20 mm, and thereby produce excellent results in warm-up period of time and in temperature follow-up capability. Moreover, the external heating member-to-fixing roller stiffness ratio is 1.09; that is, the sum of the stiffnesses of the plurality of first external heating members is larger than the stiffness of the fixing roller. Further, the pressure roller-to-fixing roller stiffness ratio is 2.91; that is, the stiffness of the pressure roller is greater than twice the stiffness of the fixing roller. Accordingly, it was possible to obtain an adequate effect of suppressing the deflection of the fixing roller and thereby produce excellent results in fixability under Condition 1 and in paper conveyance capability as well.

Because of its decreased heat capacity of the first external heating members, the fixing apparatus of Example 2 was shorter in warm-up period of time than the fixing apparatuses of Comparative examples 1 and 3. Moreover, one of the two external heating rollers disposed on the fixing-roller side was formed of an aluminum-made core member having high thermal conductivity and also had the heat pipe disposed thereinside. Accordingly, the fixing apparatus of Example 2 was more excellent in temperature uniformity than the fixing apparatus of Example 1.

In regard to the fixing apparatus of Example 3, also on the pressure-roller side was disposed the heat source. Therefore, even if the test was carried out at a copying speed of 40 copies/min.; that is, a copying speed higher than that corresponding to Condition 1, the temperature of the pressure roller could be maintained at 140° C. It would thus be seen that the fixing apparatus of Example 3 was more excellent in temperature follow-up capability and in fixability than the fixing apparatuses of Examples 1 and 2. Moreover, with the provision of a single external heating roller that was formed of an aluminum-made core member having high thermal conductivity and had the heat pipe disposed thereinside on each of the fixing-roller side and the pressure-roller side, the fixing apparatus of Example 3 was more excellent in temperature uniformity than the fixing apparatus of Example 2.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and a range of equivalency of the claims are therefore intended to be embraced therein.

What is claimed is:

1. A fixing apparatus comprising:

a pair of fixing members composed of a fixing roller and a pressure member that make contact with each other under pressure;

a first external heating belt for heating a surface of the fixing roller externally; and a plurality of first external heating members having a heat source, for allowing the first external heating belt to be suspended in a tensioned state, a sum of stiffnesses of the plurality of first external heating members being greater than or equal to a stiffness of the fixing roller.

2. The fixing apparatus of claim 1, wherein the fixing roller has a heat source disposed in its interior, whereas the pressure member has not a heat source.

3. The fixing apparatus of claim 1, wherein the stiffness of the pressure member is greater than or equal to twice the stiffness of the fixing roller.

4. The fixing apparatus of claim 1, wherein the plurality of first external heating members are designed in a same configuration, and are symmetrically arranged with respect to a line connecting a center of axis of the fixing roller and a center of a fixing nip region where the fixing roller and the pressure member are in contact with each other.

5. The fixing apparatus of claim 1, wherein one of the plurality of first external heating members is disposed, in a vicinity of an outer peripheral surface of the fixing roller, so as to be located opposite a fixing nip region where the fixing roller and the pressure roller are in contact with each other with respect to the axis of the fixing roller.

6. The fixing apparatus of claim 5, wherein, out of the plurality of first external heating members, one which is disposed, in a vicinity of an outer peripheral surface of the fixing roller, so as to be located opposite the fixing nip region with respect to the axis of the fixing roller exhibits the highest stiffness.

7. The fixing apparatus of claim 5, wherein, out of the plurality of first external heating members, one other than the first external heating member which is disposed, in the vicinity of the outer peripheral surface of the fixing roller, so as to be located opposite the fixing nip region with respect to the axis of the fixing roller is made higher in longitudinal thermal conduction than the first external heating member which is disposed, in the vicinity of the outer peripheral surface of the fixing rollers so as to be located opposite the fixing nip region.

8. The fixing apparatus of claim 5, wherein, out of the plurality of first external heating members, one other than the first external heating member which is disposed, in the vicinity of the outer peripheral surface of the fixing roller, so as to be located opposite the fixing nip region with respect to the axis of the fixing roller has not a heat source.

9. The fixing apparatus of claim 8, wherein, out of the plurality of first external heating members, one other than the first external heating member which is disposed, in the vicinity of the outer peripheral surface of the fixing roller, so as to be located opposite the fixing nip region with respect to the axis of the fixing roller is provided with a heat pipe extending along the direction longitudinally thereof.

10. The fixing apparatus of claim 1, wherein at least one of the plurality of first external heating members is designed to have a crown shape in which, when viewed in a direction longitudinally thereof, an outer diameter at its midportion is larger than an outer diameter at its opposite ends.

11. A fixing apparatus comprising:

a pair of fixing members composed of a fixing roller and a pressure member that make contact with each other under pressure;

a first external heating belt for heating a surface of the fixing roller externally;

a plurality of first external heating members having a heat source, for allowing the first external heating belt to be suspended in a tensioned state;

a second external heating belt for heating a surface of the pressure member externally; and a plurality of second external heating members having a heat source, for allowing the second external heating belt to be suspended in a tensioned state, a sum of stiffnesses of the plurality of first external heating members being greater than or equal to a stiffness of the fixing roller, and a sum of a stiffness of the pressure member and stiffnesses of the plurality of second external heating members being greater than or equal to twice the stiffness of the fixing roller.

12. The fixing apparatus of claim 11, wherein the plurality of first external heating members are designed in a same configuration, and are symmetrically arranged with respect to a line connecting a center of axis of the fixing roller and a center of a fixing nip region where the fixing roller and the pressure member are in contact with each other.

13. The fixing apparatus of claim 11, wherein one of the plurality of first external heating members is disposed, in a vicinity of an outer peripheral surface of the fixing roller, so as to be located opposite a fixing nip region where the fixing roller and the pressure roller are in contact with each other with respect to the axis of the fixing roller.

14. The fixing apparatus of claim 13, wherein, out of the plurality of first external heating members, one which is disposed, in a vicinity of an outer peripheral surface of the fixing roller, so as to be located opposite the fixing nip region with respect to the axis of the fixing roller exhibits the highest stiffness.

15. The fixing apparatus of claim 13, wherein, out of the plurality of first external heating members, one other than the first external heating member which is disposed, in the vicinity of the outer peripheral surface of the fixing roller, so as to be located opposite the fixing nip region with respect to the axis of the fixing roller is made higher in longitudinal thermal conduction than the first external heating member which is disposed, in the vicinity of the outer peripheral surface of the fixing roller, so as to be located opposite the fixing nip region.

16. The fixing apparatus of claim 13, wherein, out of the plurality of first external heating members, one other than the first external heating member which is disposed, in the vicinity of the outer peripheral surface of the fixing roller, so as to be located opposite the fixing nip region with respect to the axis of the fixing roller has not a heat source.

17. The fixing apparatus of claim 16, wherein, out of the plurality of first external heating members, one other than the first external heating member which is disposed, in the vicinity of the outer peripheral surface of the fixing roller, so as to be located opposite the fixing nip region with respect to the axis of the fixing roller is provided with a heat pipe extending along the direction longitudinally thereof.

18. The fixing apparatus of claim 11, wherein at least one of the plurality of first external heating members is designed to have a crown shape in which, when viewed in a direction longitudinally thereof, an outer diameter at its midportion is larger than an outer diameter at its opposite ends.

19. The fixing apparatus of claim 11, wherein the plurality of second external heating members have a same construction as the plurality of first external heating members.

20. An image forming apparatus having the fixing apparatus of claim 1.

21. An image forming apparatus having the fixing apparatus of claim 11.

* * * * *